US006056453A

United States Patent [19]

Hufman et al.

[11] Patent Number: 6,056,453

[45] **Date of Patent: *May 2, 2000**

[54] METHOD OF MANUFACTURE OF AN ELECTROSTATIC WRITING HEAD HAVING INTEGRAL CONDUCTIVE PADS

[75] Inventors: James R. Hufman, Milpitas; Joseph A. Chizuk, Jr.; George W. Davis, both of Santa Clara; Charles F. Hurst, Campbell; Derrick Arnold Kendrick, Hayward; Michael A. Sprauve, San Jose; Kenneth R. Chew, Cupertino, all of Calif.

[73] Assignee: Xerox Corporation, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/770,309

[22] Filed: Dec. 20, 1996

[51] Int. Cl.[7] ..... B41J 2/39; B41J 2/395; B41J 2/40

[52] U.S. Cl. ..... 397/142

[58] Field of Search ..... 342/142; 29/592.1, 29/605, 825; 174/250, 19

[56] References Cited

U.S. PATENT DOCUMENTS

| | | | |
|---|---|---|---|
| 3,618,118 | 11/1971 | Lloyd | 346/74 ES |
| 3,693,185 | 9/1972 | Lloyd | 346/139 C |

(List continued on next page.)

FOREIGN PATENT DOCUMENTS

| | | |
|---|---|---|
| 51-27089 | 3/1973 | Japan . |
| 51-43729 | 7/1973 | Japan . |
| 48-66718 | 9/1973 | Japan . |
| 49-12427 | 3/1974 | Japan . |
| 52-79807 | 6/1977 | Japan . |
| 55-110245 | 7/1980 | Japan . |
| 56-146356 | 11/1981 | Japan . |
| 57-208267 | 12/1982 | Japan . |
| 62-299346 | 12/1987 | Japan . |
| 3-36026 | 5/1991 | Japan . |
| 2 009 051 | 6/1979 | United Kingdom . |

OTHER PUBLICATIONS

European Search Report from Related Application No. 97309991.4–2304 dated May 6, 1999 with modified abstract.

Mitchell, J.W. et al. "Silicon–Based Printhead Design" IBM Technical Disclosure Bulletin, vol. 22, No. 12, May 1980, pp. 5496–5498.

Chai, H.D. et al. "Integrated Modular Write Head for Non–Impact Printers" IBM Technical Disclosure Bulletin, vol. 25, No. 7A, Dec. 1982, pp. 3527–3528.

*Primary Examiner*—John Barlow
*Assistant Examiner*—Raquel Yvette Gordon

[57] ABSTRACT

A method of manufacturing an electrostatic writing head automatically bonds conductors that form the writing electrodes of the head to a head member in a spaced parallel relationship according to the desired pitch of the writing head. The writing head includes a set of first surface conductive pads permanently fixed to a first surface of the first head member and disposed in a lengthwise row, and a set of second surface conductive pads permanently fixed to the second surface of the first head member. Each second surface conductive pad is paired with one of the first surface conductive pads, and the pair of pads is electrically connected by way of a conductive via extending through the first head member. The conductors are automatically bonded at one end to a respective one of the first surface conductive pads. The other end of each conductor is bonded to a bonding area that is later removed by cutting, thereby exposing the tips of the conductors in at least one line to produce the nib line of the head. The conductive pads may be arranged in a variety of novel arrangements that provide great flexibility in design in order to accommodate a wide variety of writing head pitches and lengths. The automatic bonding process is under processor control and is able to bond conductors according to a repetitive pattern consistent with a specific arrangement of the conductive pads.

15 Claims, 29 Drawing Sheets

U.S. PATENT DOCUMENTS

| | | | |
|---|---|---|---|
| 3,793,107 | 2/1974 | Lloyd | 156/174 |
| 4,058,814 | 11/1977 | Brown, Jr. et al. | 346/154 |
| 4,115,763 | 9/1978 | Brown, Jr. et al. | 340/166 |
| 4,315,270 | 2/1982 | Lloyd et al. | 346/155 |
| 4,569,584 | 2/1986 | St. John et al. | 355/14 R |
| 4,766,448 | 8/1988 | Hack et al. | 346/150 |
| 4,806,957 | 2/1989 | Beegan | 346/155 |
| 4,920,363 | 4/1990 | Hack | 346/155 |
| 4,926,199 | 5/1990 | Bibl et al. | 346/157 |
| 4,977,416 | 12/1990 | Bibl et al. . | |
| 5,128,697 | 7/1992 | Bibl et al. | 346/155 |
| 5,181,050 | 1/1993 | Bibl et al. | 346/155 |
| 5,237,346 | 8/1993 | Da Costa et al. | 346/155 |
| 5,343,232 | 8/1994 | Ueno . | |
| 5,489,934 | 2/1996 | Hack | 347/141 |
| 5,600,354 | 2/1997 | Hackleman | 347/50 |

METHOD OF MANUFACTURE OF AN ELECTROSTATIC WRITING HEAD HAVING INTEGRAL CONDUCTIVE PADS

CROSS REFERENCE TO RELATED APPLICATIONS

The present invention is related to inventions that are the subject matter of other concurrently filed, commonly assigned U.S. patent applications, some of which have inventors in common with the subject application, and which have the following application numbers and titles: Application No. 08/778,163, entitled "Electrostatic Writing Head Having Integral Conductive Pads"; Application No. 08/771,407, entitled "Electrostatic Writing Head Having A Head Member Of Multiple Joined Sections" now issued as U.S. Pat. No. 5,815,189; and application Ser. No. 08/853,962, entitled "Method for Joining Substrates".

BACKGROUND OF THE INVENTION

The present invention relates generally to electrographic marking devices, and more particularly, to a writing head, also referred to as a print head or a recording head, for producing latent electrostatic charge patterns on an insulating medium to form a visible image.

The electrographic marking process for producing a single-color visible image can be generally and briefly characterized as a two step process: The first step involves forming an electrostatic latent image on a medium at a writing station using a writing head. The second step involves rendering visible the electrostatic latent image that is deposited on the medium by toning or developing the latent image using a liquid or dry toner in the selected color. In the case of dry toner, some type of fusing of the toner to the medium may be employed, as, for example, a process known as flash fusing. In the case of liquid toner or ink provision may be made to aid in the removal of excess ink followed by the drying of the liquid toned medium surface. The result in either case is a permanent and fixed single-color image formed on the medium. The forming of full color electrostatic images generally involves depositing latent images of the color separations that comprise the full color image in registration with each other on the medium; while there may be considerable complexity in registering the multiple latent images, the writing of each individual image generally follows the two-step process just discussed. An example of a color electrographic image-forming apparatus and a method for forming a full color image using the device are described in U.S. Pat. No. 4,569,584.

In an electrographic marking device, an exemplary writing head comprises a plurality of writing electrodes physically positioned to electrically address a dielectric surface of the medium as the medium travels through the writing station. An aligned series of backup electrodes is positioned opposite to the writing electrodes of the writing head in a manner that leaves a small gap, and the medium on which the image is to be formed passes through this gap. When the potential difference between the addressed writing electrodes and the opposed backup electrodes is raised to a threshold level of several hundreds of volts, referred to as the Paschen breakdown point, an electrostatic charge is deposited on the dielectric portion of the medium as that medium is moved through the gap. The timing and sequencing of energization of the electrodes provides for electrical charging of selected areas of the medium to form a desired latent image as the medium is moved through the writing station.

When the image to be formed on the medium is considered to be structured as a two-dimensional array of rows and columns of image spots, the latent image is typically formed row by row (or column by column), requiring the writing head to contain a writing electrode, referred to as a "nib" herein, for each spot to be formed in a row (or column) of the image. Thus, the writing head must be as wide as the visible image desired, which is typically related to the width of the medium, and the nibs must be as closely spaced as necessary to form a visible image having the desired resolution. The closely spaced nibs, however, must be able to be independently electrically controlled, requiring a suitable electrical connection from each nib to circuitry that controls the formation of the image. The line of closely spaced nibs will be referred to herein as the "nib line" of the writing head, and each row of the latent image produced by the nib line will be referred to as a "scan line" of the image.

U.S. Pat. No. 3,693,185 issued in 1972 to Lloyd discloses an electrostatic writing head that comprises first and second series of conductors disposed in spaced, parallel relation and having a pair of elongated, insulative head members secured together in confronting relation that sandwich one end of each of the conductors therebetween. The tips of the conductor ends positioned between the head members are the writing electrodes or nibs, and are exposed in a line lying substantially in a plane between the insulative head members; this line of nibs forms the nib line of the writing head. The writing head disclosed in U.S. Pat. No. 3,693,185 further includes first and second elongated handling elements that are readily and releasably secured to each of the other end of the first and second series of conductors, respectively, so that the ends of the conductors to be connected to the drive circuitry can be readily peeled from these elongated handling elements and soldered to a printed circuit board, for example to make the appropriate electrical connections. Lloyd discloses that the elongated handling elements permit the wires to be handled so as to minimize their entanglement with one another.

U.S. Pat. No. 3,693,185 and 3,793,107 (hereafter also referred to as the Lloyd patents) disclose a method of construction of this writing head that involves winding a length of wire about a mandrel to form uniformly laterally spaced convolutions of wire. An elongated strip of insulative material that is coated with a hardenable adhesive material extends transversely to the plane of the uniformly spaced wire convolutions and is positioned beneath them. This coated strip is then moved radially outwardly of the convolutions to urge the adhesive material against portions of the convolutions. Then another strip of insulative material is adhered to the convolutions in confronting relation to the first named strip so as to sandwich portions of the convolutions between the confronting strips. The strips are then compressed tightly together and after permitting the adhesive material to harden, the convolutions and strips are severed by cutting through both the strips and the convolutions along a line extending lengthwise of the strips; each of the two lines of wire tips exposed by the cutting operation forms the nib line of a writing head.

FIG. 35 illustrates the apparatus for making the writing head as just described, and FIG. 36 illustrates four writing heads produced as a result of this process, after cutting through both strips 13 and 14 and the convolutions of wire along a line 15 extending lengthwise of the strips. Individual nibs 12 become exposed as a result of the cutting process. FIG. 36 also shows elongated handling elements 49, 56, 51 and 57 that protect the other ends of the conductors. It has been estimated that constructing writing heads according to the process disclosed in U.S. Pat. No. 3,693,185 and variations thereof takes an average of 5.5 hours to complete the wire winding process alone and requires eleven (11) miles of wire for a single winding, which for wide writing heads (e.g., 54 inches) results in the production of only one nib line.

In one implemen tation of an electrostatic writing head similar to the one disclosed in U.S. Pat. No. 3,693,185, the ends of the conductors to be connected to the electronics circuitry that will drive the nibs are connected in the manner shown in FIG. 37, where multiple nibs 136, 138, 140 and 142 of nib line 130 are connected to a single driver 134 on high voltage driver board 132. This type of connection is a multiplexed connection, where a single driver drives more than one nib. It can be seen that this connection process involves manipulating the connector ends of the nibs in a type of weaving process, where wire conductors are threaded across other wire conductors in order to be soldered to the appropriate driver. The weaving process is currently an entirely manual process requiring skilled labor and approximately sixty (60) hours of weaving to complete a nib line. There may be an additional two to as much as ten hours of corrective weaving work after heads are tested and found to fail; much of this reworking involves correcting wires that have been connected to the wrong drivers.

Writing heads may be made in a variety of widths using this process, which provides flexibility for producing multiple smafler-width writing heads from a single winding. For wide image marking requirements, however, such as for devices that support engineering, architecture and graphic arts applications, the writing heads are typically made in single, full-width units. The maximum width of a nib line is subject to the capabilities of the winding apparatus, and considerable retooling of equipment would be required to enlarge the width. Moreover, the wider the writing head desired or the higher the pitch of the writing head, the longer and more costly is the manual weaving process required to connect the wires to the high voltage driver boards.

In addition, it is readily apparent that a writing head made according to this existing process is a bulky and cumbersome component of the electrostatic marking device, with literally thousands of strands of fine gauge wire that are directly connected to the driver board circuitry and consequently need to be carefully protected from damage. Protection of these wires is typically accomplished at various stages of the writing head construction process through the use and application of various types of paper- and fabric-based tapes that function to hold the wires in place and to protect them from breaking during the steps of construction. For example, during the weaving process tapes are used as a protective covering, around the wires between the head members that secure the nib line and the driver boards. The tapes are manually applied and removed, and are an added expense in the construction of each writing head.

Still another disadvantage of the existing method for constructing a writing head is the ability to control the placement of the wires that form the nib line with the winding device during winding of the wires. The wires that form the nib line must be laid down during the winding in a manner that maintains a precise inter-wire spacing requirement that is related to the resolution, or pitch, of the desired image, and the size of the toner or ink spot that is deposited on the medium. This requires that a sufficient but not excessive amount of tension be applied to the wire during the winding process to maintain the correct inter-wire spacing between the wire without breaking it. As the desired image resolution increases, the wire becomes finer and finer and is thus more susceptible to breakage, thus reducing the yield of writing heads that may be produced from the process described in U.S. Pat. No. 3,693,185.

Thus it is apparent that there are several disadvantages to producing writing heads according to the process disclosed in U.S. Pat. Nos. 3,693,185 and 3,793,107 and having the structural configuration shown therein.

SUMMARY OF THE INVENTION

The present invention is based on the observation that the manual and individual connection of the writing electrodes to the writing head driving circuitry is a major factor in the manufacturing cost of an electrostatic writing head as well as a major source of writing head failure. The present invention is premised on the discovery that the permanent integration on the surface of one of the writing head members of a junction mechanism for flowing charge from the writing head driving circuitry to the writing electrodes eliminates the manual connection of the writing electrodes to the driving circuitry, and produces a very compact writing head that involves significantly less manual labor to manufacture and significantly reduces the quantity of wire needed, labor time and number of parts in comparison with the writing head described in the Lloyd patents. One such junction mechanism comprises two sets of conductive pads that are attached to permit an electric charge to pass from an external source (i.e. the writing head driver board) to the writing electrodes.

In addition, the writing head of the present invention is am enable to a number of writing electrode configurations that support a variety of writing head lengths and image resolutions. The conductive pads can be arranged on the head member in a single row, or in offset multiple rows to permit more writing electrodes to be arranged on the head member, thus forming a nib line capable of writing an image in one of a variety of image resolutions. Moreover, the conductive pads can be arranged on the head member so as to permit the writing, electrodes to be arranged to form a single nib line, or to form multiple nib lines, which may be used either to write two images, or to write a single image at a faster speed. The use of a junction mechanism such as the conductive pads that are integral with the head member permit a wide variety of writing head configurations that may be manufactured at a low cost with very little manual labor.

In addition, a method of manufacturing the writing heads disclosed herein has been developed that significantly reduces the manual labor required to produce a writing head. This method automates the bonding of the conductors to the surface of a first head member to form the nib line of the writing head. This automated process, referred to as "stitching" uses a processor controlled apparatus that moves a bonding apparatus in a repetitive pattern to bond the conductors in the required spaced parallel relationship. Since the conductive pads are integral with the head member and conductors are relatively short in length, cost savings in wire as well as manual labor result from the novel stitching method disclosed herein.

For further flexibility in the design of writing heads made according to the present invention, the first head member of a writing head to which the conductors are bonded may be composed of individual head member sections that are joined prior to the stitching of the conductors. This enables a writing head to be made at a wide variety of lengths, such as for example a 54 inch length, with very few limitations. To accommodate embodiments of the writing head that make use of rows of conductive pads that are offset from each other, each individual head member section to be joined to another may have a lateral edge of a specific contour to ensure that each row of conductive pads is spaced across the gap formed by abutting two complementary lateral edges to provide a pad in the proper position for bonding conductors in the spaced parallel relationship they require. Increased interpad spacing, and increased pad width allow for the cut of this lateral edge contour to vary from exactly half the interpad distance and to be within a predetermined tolerance and still maintain the proper conductor spacing.

The process of joining head member sections has been tailored to the precise requirements of the substrates being joined. It is important for the complete unitary first head member composed of joined sections to have the necessary rigidity and strength to function as a writing head in the electrostatic marking device. Thus, the joints at joined edges must be strong, The joining process itself must not contaminate the conductive pads in any way that would prevent electrical charge from flowing to the conductors. The joining process disclosed uses a stiffening member and a liquid adhesive material as a joining material that is applied in a manner that protects the conductive pads from damage.

Therefore, in accordance with one aspect of the present invention, a method for manufacturing an electrostatic writing head having a nib line comprises seating a working substrate in a predetermined initial x, y, z substrate position on a tooling fixture. The working substrate has first and second bonding regions on a first surface thereof; the first surface defines a plane in space. The method further comprises setting an initial x, y, z bonding position of a bonding apparatus relative to the initial x, y, z substrate position of the working substrate: Then, for each conductor of a plurality of conductors to be bonded to the working substrate, one of the initial x, y, z substrate position or the initial x, y, z bonding position of the bonding apparatus is adjusted by an x, y, z change distance to produce a current bonding position, and the bonding apparatus is activated to bond, at the current bonding position, a first end of a conductor to one of the first or second bonding regions. The adjusting and activating steps are then repeated for the second end of the conductor which is bonded to the other of the first or second bonding regions. The conductor is then terminated. After all conductors have been bonded, an encapsulating member is secured to the working substrate. The encapsulating member restrains the plurality of conductors in fixed positions relative to the plane of the first surface of the working substrate. The assembly of working substrate, conductors and encapsulating member is then cut transversely to expose a surface of each conductor, the surfaces of all conductors, lying in at least one line and collectively forming the nib line of the writing head.

According to another aspect of the invention, at least one of the bonding areas comprises at least one row of adjacent conductive pads separated from each other by a fixed center-to-center distance. Adjusting one of the initial x, y, z substrate position or the initial x, y, z bonding position of the bonding apparatus by an x, y, z change distance to produce a current bonding position includes computing the x, y, z change distance using the center-to-center distance between pairs of adjacent conductive pads. The at least one row of conductive pads may include at least two offset rows of conductive pads, such that each conductive pad in a first row of the conductive pads is offset from a next consecutive conductive pad in a second row of the conductive pads by an offset distance. Each pair of consecutive conductive pads is separated by a fixed center-to-center distance. In this aspect of the invention, adjusting one of the initial x, y, z substrate position or the initial x, y, z bonding position of the bonding apparatus by an x, y, z change distance to produce a current bonding position includes computing the x, y, z change distance using the offset distance and using the center-to-center distance between pairs of consecutive conductive pads.

The novel features that are considered characteristic of the present invention are particularly and specifically set forth in the appended claims. The invention itself, however, with respect to its structure, method of construction and method of operation, together with its advantages, will best be understood from the following description when read in connection with the accompanying drawings. In the Figures, the same numbers have been used to denote the same component parts or steps. The description of the invention includes certain terminology that is specifically defamed for describing the embodiment of the claimed invention illustrated in the accompanying drawings. These defined terms have the meanings indicated throughout this specification and in the claims, rather than any meanings that may occur in other sources such as, for example, documents, if any, that are incorporated by reference herein elsewhere in this description.

DETAILED DESCRIPTION OF THE INVENTION

A. Structural Description of the Writing Head.

Figure 33:
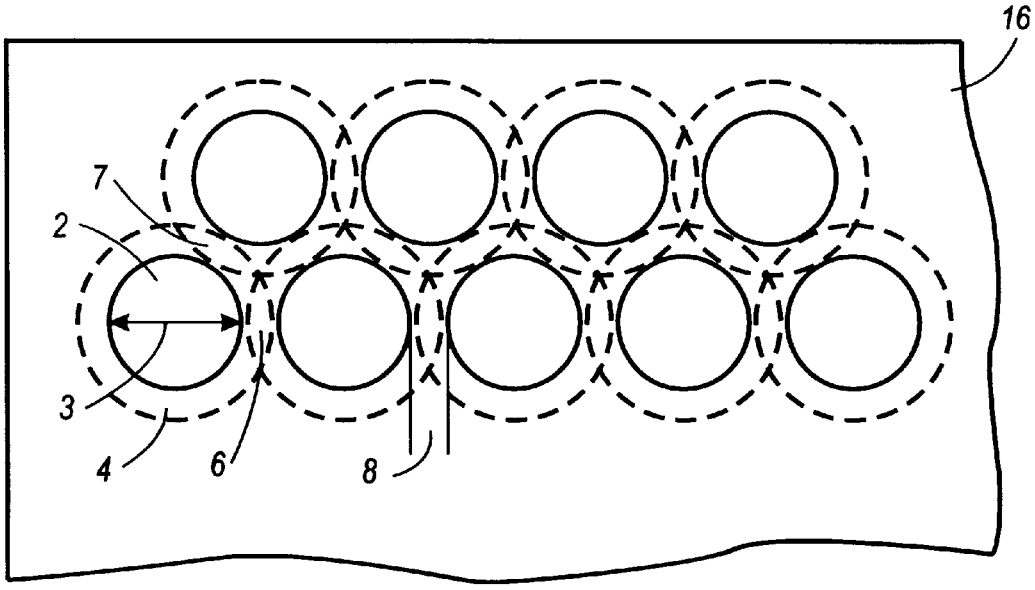
FIG. 33 illustrates basic characteristics of the deposition of charge on a medium by writing electrodes in an electrostatic marking device.

The design of the writing head of the present invention and its many variations described in detail below is premised on several fundamental principles of electrostatic image formation that are reviewed briefly here before proceeding to the details of the writing head structure. These principles are generally illustrated in FIG. 33.

The pitch of the writing head is exactly the same as the desired resolution of the image to be produced; image resolution is described in terms of spots, or dots, per inch of the medium, as measured in both the horizontal x, or width, dimension and the vertical y, or height, dimension. With reference to FIG. 33, each nib produces a spot 2 of charge on dielectric medium 16 as medium 16 passes in close proximity to the nib line; the spot of charge is shown as a circle with a solid outline in FIG. 33. The size 3 (e.g., diameter or width) of spot 2 is directly equivalent to the size of the bare wire writing electrode that produced the charge. However, spot 2 is only one component of the total spot size produced by each nib. It is known that each spot spreads, or grows, on the medium by a growth factor that is affected by the width, or diameter, of the wire used and by whether a negative or positive charge is deposited; the growth factor is about 10% of the spot size, shown in FIG. 33 as a circle 4 with a dashed line outline. In addition, it is desirable for achieving high image quality that the spots overlap in both the x and y directions of medium 16 by a small amount in order to avoid striations in the image that result from empty color areas where no charge has been developed at the same time the size of this overlap must be carefully controlled to avoid producing changes in hue from colors mixing in the overlapped image areas. Generally an overlap between spots in both the x and y directions, shown in FIG. 33 as overlap 6 and overlap 7, respectively, is acceptable when it is a small percentage of the of the spot size. It can be seen that the desired overlap affects the computation of the distance 8 between adjacent spots in both the x and y directions. Further, if insulated wire is used in the writing head, the expected growth factor affects the calculation of the maximum thickness of the insulation that can be used; as a general rule, insulation thickness must be smaller than the expected growth factor by two to three percent (2%–3%).

Thus, the pitch of the writing head is a function of the width, or diameter, of the bare wire used to produce the charge on the medium, the expected growth factor given the characteristics of the wire and the type of charge used, and the desired overlap between the spots. These characteristics can be summarized as follows:

$$\text{bare wire width} + \text{expected growth factor} = \text{spot size}$$

$$\text{pitch} = \frac{1}{\text{spotsize} - \text{overlap}}. \text{ and}$$

$$\text{spot size} - \text{overlap} = \frac{1}{\text{pitch}}.$$

Thus, the size of the bare wire to be used and its spacing with respect to adjacent wires can be computed as a function of the desired pitch of the writing head. In the description of the writing head that follows, examples of specifications such as wire diameters and pad sizes and spacings are used to illustrate various optimal configurations of the writing head structure. It is to be understood, however that the basic principles described above permit numerous variations and combinations of structures in addition to those specifically described herein, and that the appended claims are intended to encompass all such variations and combinations.

1. General Features of the Writing Head of the Present Invention.

Figure 1:
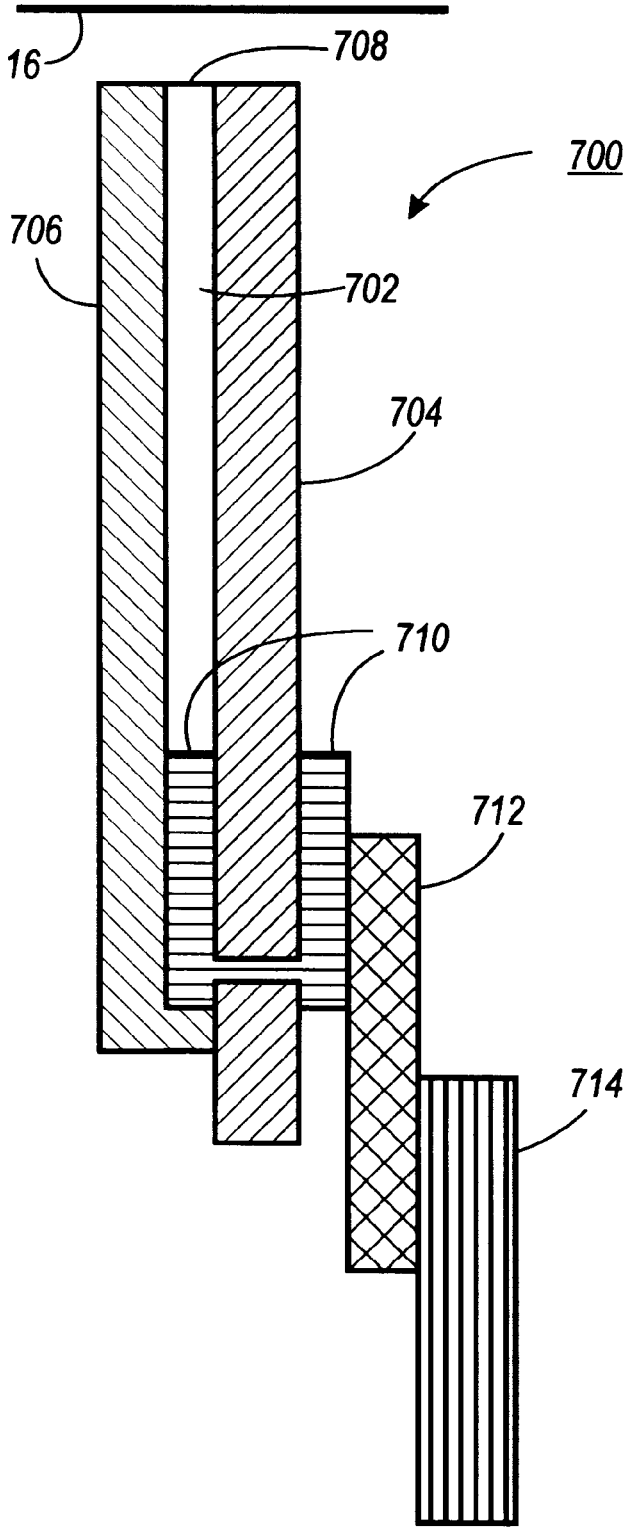
FIG. 1 is a schematic side view of the component elements of a first configuration of the writing head of the present invention.
Figure 2:
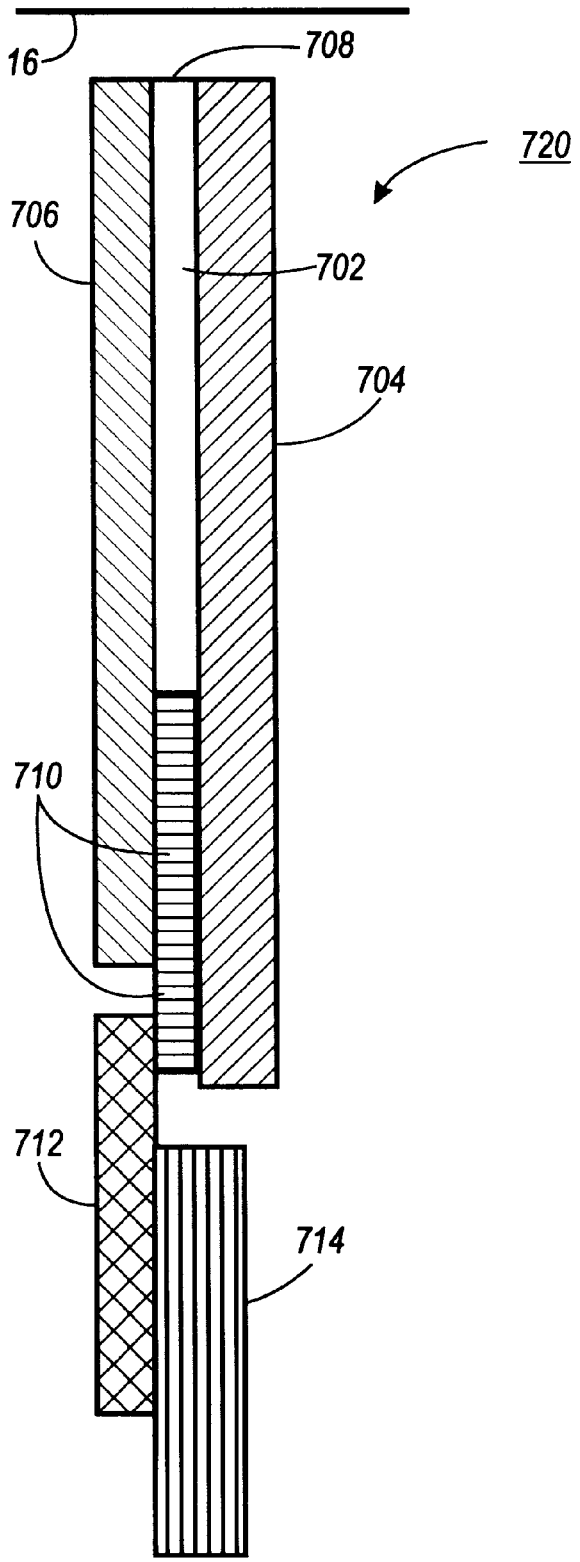
FIG. 2 is a schematic side view of the component elements of a second configuration of the writing head of the present invention.

FIGS. 1 and 2 schematically illustrate the general features of the structural configuration of the writing head of the present invention, as viewed from the side of the writing head, with medium 16 on which a latent image is to be formed shown at the top of each figure. Writing head 700 illustrated in FIG. 1 is comprised of a first insulative, elongated head member 704 and a second insulative, elongated head member 706 joined to first head member 704 so as to encapsulate conductors 702. One end of conductors 702 form nib line 708 which deposits electrical charge on dielectric medium 16. The other end of conductors 702 are attached to conductive junction mechanism 710, a portion of which is on a first surface of first head member 704 and a portion of which is on a second surface of first head member 704, with a conductive opening joining the two portions. The portion of conductive junction mechanism, 710 on the second surface of first head member 704 is attached to connecting mechanism 712 which connects conductive junction mechanism 710 to writing head driver circuitry 714. Writing head 720 illustrated in FIG. 2 is similarly comprised of a first head member 704 and a second head member 706 joined to first head member 704 so as to encapsulate conductors 702. One end of conductors 702 are attached to conductive junction mechanism 710, all of which is on the top surface of first head member 704 but a portion of which is outside second head member 706, with a conductive opening joining the two portions.

2. A Writing Head with a Single Nib Line and Integral Conductive Pads.

Figure 3:
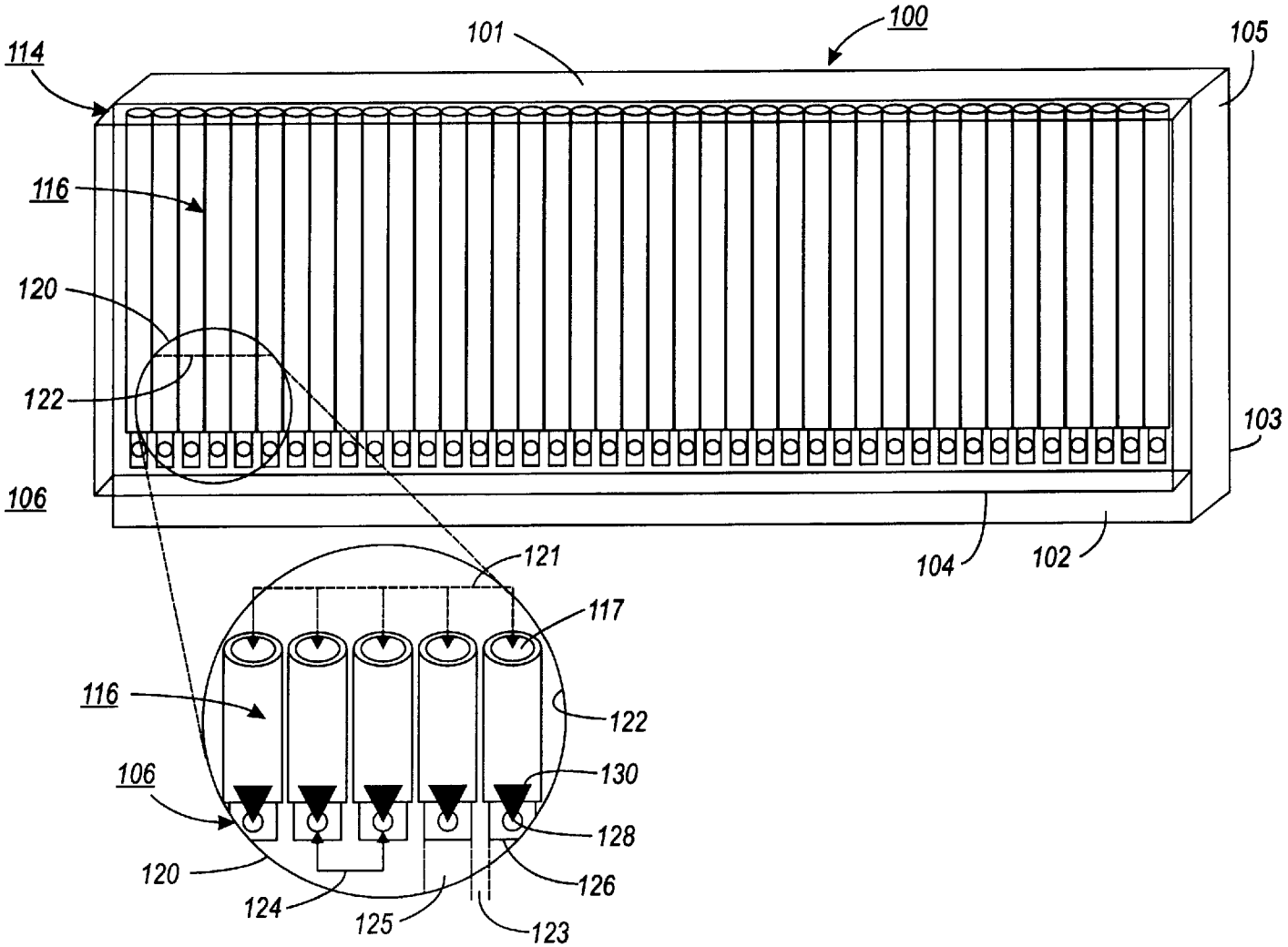
FIG. 3 is a schematic front perspective view of the writing head of FIG. 1 showing integral conductive pads and an enlarged detailed view of the placement of the conductors.

FIG. 3 shows writing head 100 of the present invention in a basic embodiment. First head member 101, positioned at the back of FIG. 3, and second head member 104, positioned in the forefront of FIG. 3, are elongated, insulative rigid or semi-rigid members secured together in a confronting relationship in order to encapsulate a set of conductors 116, or writing electrodes, positioned in spaced parallel relation on first head member 101. Head member 101 may be made of any suitable insulative material; a fiber glass material known as FR4 or G10 is an example of a suitable substrate. In the method of making the writing head of the present invention described below, it will also be seen that one or both of the head members may be formed of a liquid material that then hardens into a suitable rigid insulative substrate. In particular, second head member 104 may be formed of a liquid epoxy that is applied after writing electrodes 116 are positioned on first head member 110; the epoxy then hardens in a manner that secures conductors 116 in position on the top surface of head member 10, so as to make writing head 100 of substantially unitary construction. Note that second head member 104 is shown as being transparent solely for purposes of viewing the component parts of writing head 100, and it is understood that second head member 104 need not be made of a transparent material.

Figure 4:
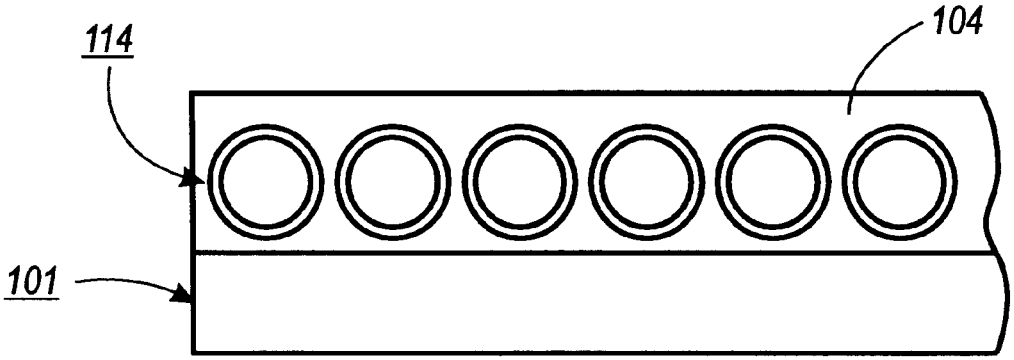
FIG. 4 is a schematic top view of a portion of the writing head of FIG. 3 showing a portion of the nib line formed by the conductors.

One end of each of the writing electrodes 116, referred to as a nib, form nib line 114, which is partially exposed at the top edge of writing head 100, and which is the end of the writing electrodes that deposit charge on the dielectric medium (not shown) on which the image is to be formed during the writing process. FIG. 4 illustrates a portion of writing head 100 from a view of the top edge thereof, showing nib line 114 encapsulated between first and second head members 101 and 104, respectively. As noted earlier, when a single nib deposits a charge on a medium during the recording or writing process, the charge forms a single spot of foreground color in the final image formed on the medium, and the number of nibs in nib line 114 is directly related to the resolution of the image formed. Conductors 116 may be made of any suitable type of wire, such as nickel, silver, copper, gold and aluminum.

With reference again to FIG. 3, for purposes of identifying the location of its components, first head member 101 may be described as having a top region near the top edge of head member 101 and a bottom region near the bottom edge of member 101. First head member 101 also has a top surface 102 and a bottom surface 103. Writing head 100 further includes a row 106 of conductive pads positioned in the bottom region of top surface 102 of first head member 101. Conductive pads 106 serve as the junction point of conductors 116 and the electronic circuitry (not shown) that energizes the writing head. Cutaway portion 120 shows a portion of the top surface 102 enlarged to show the details of conductive pads 106 and the connections of writing electrodes 116 to the pads. Each conductive pad 126 comprises a small conductive region permanently attached to top surface 102, and having an opening 128, referred to as a conductive via, positioned on the surface of the pad.

Figure 5:
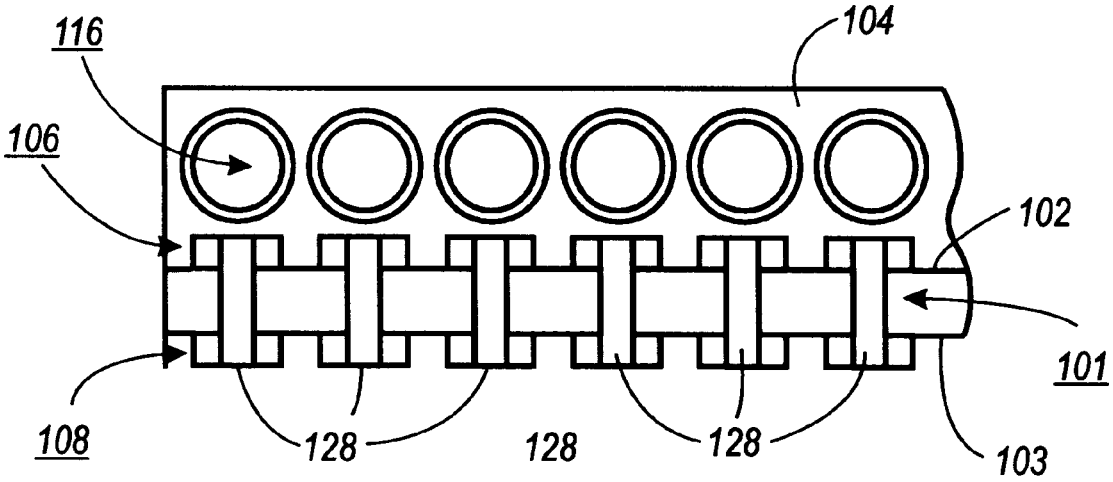
FIG. 5 is a schematic bottom view of a section of the writing head of FIG. 3 as cut transversely through the center of the row of conductive pads, showing the top and bottom surface conductive pads.

FIG. 5 illustrates a view of a portion of writing head 100 from its bottom edge. First head member 101 is shown as having conductive pads 106 on top surface 102, with conductors 116 positioned on the surfaces of respective pads and encapsulated by second head member 104. A second set of conductive pads 108 is permanently attached to bottom surface 103 of first head member 101, each in a paired positional relationship with one of the first set of conductive pads 106 to allow each conductive via 128 to extend completely through a conductive pad attached to top surface 102 and through a paired conductive pad attached to bottom surface 103 of first head member 101. Each conductive pad in one of the sets of conductive pads 106 and 108 is the same size as others in the set. However, pads in one set may, but need not, be sized differently from pads in the other set, as shown in the figure.

The surface of each conductive pad 106 must be of the type to allow for the permanent attachment of one end of each of conductors 116; cutaway portion 120 of FIG. 3 shows that each one of conductors 116 is permanently attached to a respective pad 126 by a suitable bonding process represented as black triangle 130. Conductive pads 106 and 108 and vias 128 may each be made of copper or a similar material of the type that conducts an electrical charge to conductor 117. Conductive pads 106 and 108 with conductive vias 128 may be fabricated using conventional plated hole-through technology used in the fabrication of printed circuit boards. This process is described in more detailed below.

With continued reference to cutaway portion 120 of FIG. 3, the pitch of writing head 100 in the configuration shown in FIG. 3 is limited by the capabilities of printed circuit board technology at this time. Conductive pads 106 have a width 125 and are spaced a fixed distance 123 apart on top surface 102. Existing printed circuit board technology allows for the etching of pads having a ten millimeter (10 mils) width and an interpad spacing of three to five millimeters (3–5 mils). Assuming a minimum total pad-plus interpad spacing of 13 mils, writing head 100 has a maximum pitch of between seventy-five and eighty (75–80) spots per inch. It will be appreciated by those of skill in the art that the pitch of writing head 100 with its single row of conductive pads may be increased by using other technologies that are, or will be, capable of producing smaller conductive pads with plated holes or conductive pads that have a smaller interpad spacing.

Each conductor 117 must each be positioned on top surface 102 to fall on a respective conductive pad 126. When center-to-center distance 124 between pairs of adjacent conductive vias 128 is 13 mils, center to center positioning 121 of adjacent wires must be 13 mils; the size of the wire that may be used, computed using the image formation characteristics described above, is constrained by these measurements.

Figure 6:
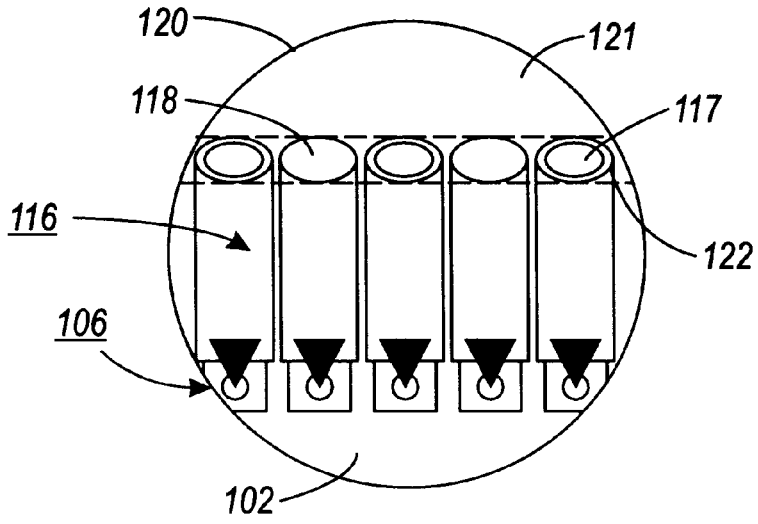
FIG. 6 is a schematic enlarged view of a portion of the conductors of the writing head of FIG. 3 showing an arrangement of alternating ones of insulated and non-insulated conductors.
Figure 7:
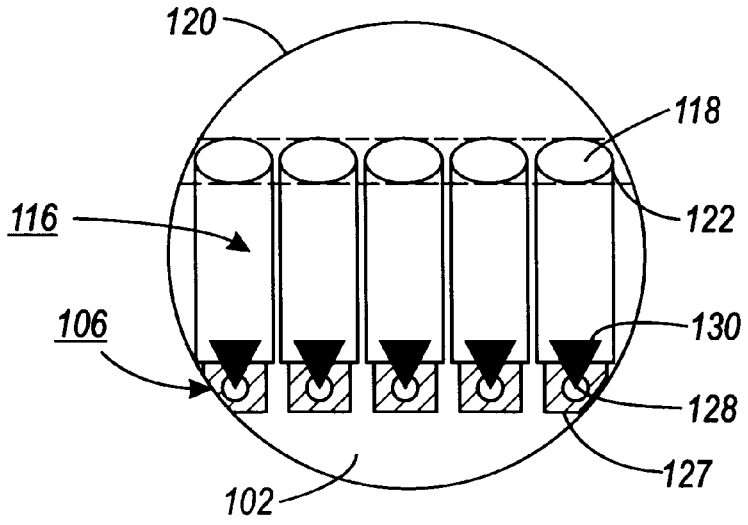
FIG. 7 is a schematic enlarged view of a portion of the conductors of the writing head of FIG. 3 showing non-insulated conductors and conductive pads having an insulated coating.

Conductors 116 are illustrated as insulated wires in cutaway portion 120 of FIG. 3. Insulated conductors may be placed in close parallel spacing on top surface 102 of head member 101 without concern for electrical shorting between adjacent wires. However, non-insulated wires may also be used in the configuration of writing head 100. FIG. 6 shows cutaway portion 120 having writing electrodes 116 composed of alternating insulated and noninsulated wires 117 and 118 respectively. Still another configuration of wires and conductors is shown in FIG. 7, where all writing electrodes 116 are shown as noninsulated wire; to prevent electrical shorting between wires; the wires must not touch and conductive pads 106 must have an insulated coating, as illustrated by the diagonal crosshatching shown on each pad.

3. A Writing Head With Two Rows of Conductive Pads.

The conductive pads that serve as the junction mechanism between the writing head and the writing head driver circuitry in the embodiment of FIG. 3 may be arranged in a variety of configurations on first head member 101. These variations provide flexibility in designing a writing head of varying pitch; as will be described further below, these variations also provide flexibility in designing, a writing head of varying length.

Figure 8:
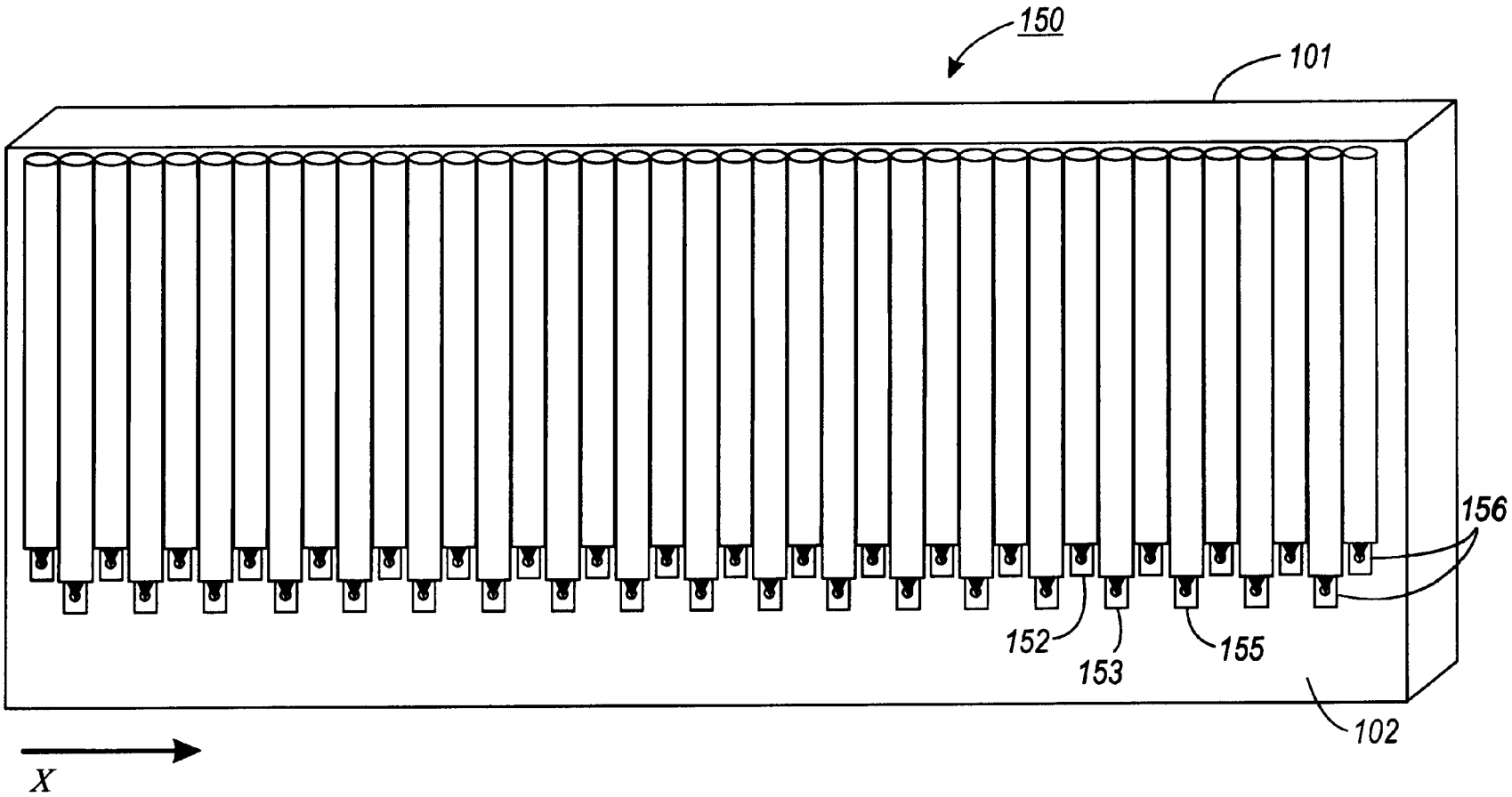
FIG. 8 is a schematic perspective front view of the first head member of the writing head of FIG. 3 showing an alternative arrangement of the conductive pads in two offset rows.

FIG. 8 shows writing head 150, another embodiment of the present invention, which has two rows 156 of conductive pads. With the exception of the various arrangements of the conductive pads in two rows that are described below, all other characteristics and properties of writing head 150 are the same as those described for writing head 100 illustrated in FIG. 3. Rows 156 of conductive pads may be configured in any one of three arrangements, illustrated in FIGS. 9, 10 and 11. In each arrangement, every other pad in the single row 106 of conductive pads of FIG. 3 is positioned in a second row of pads positioned below single row 106, towards the bottom edge of first head member 101. For ease of reference, pads adjacent to each other in the same row, such as pads 153 and 155, are referred to as "adjacent pads"; conductive pads that are consecutively positioned with respect to the x direction of top surface 102 of first head member 101, regardless of what row they are in, are referred to as "consecutive pads". Conductive pads 152 and 153 are examples of consecutive pads. Alternatively, the conductors may be noninsulated as shown in FIG. 7, provided they do not touch and the conductive pads have an insulating coating.

Figure 9:
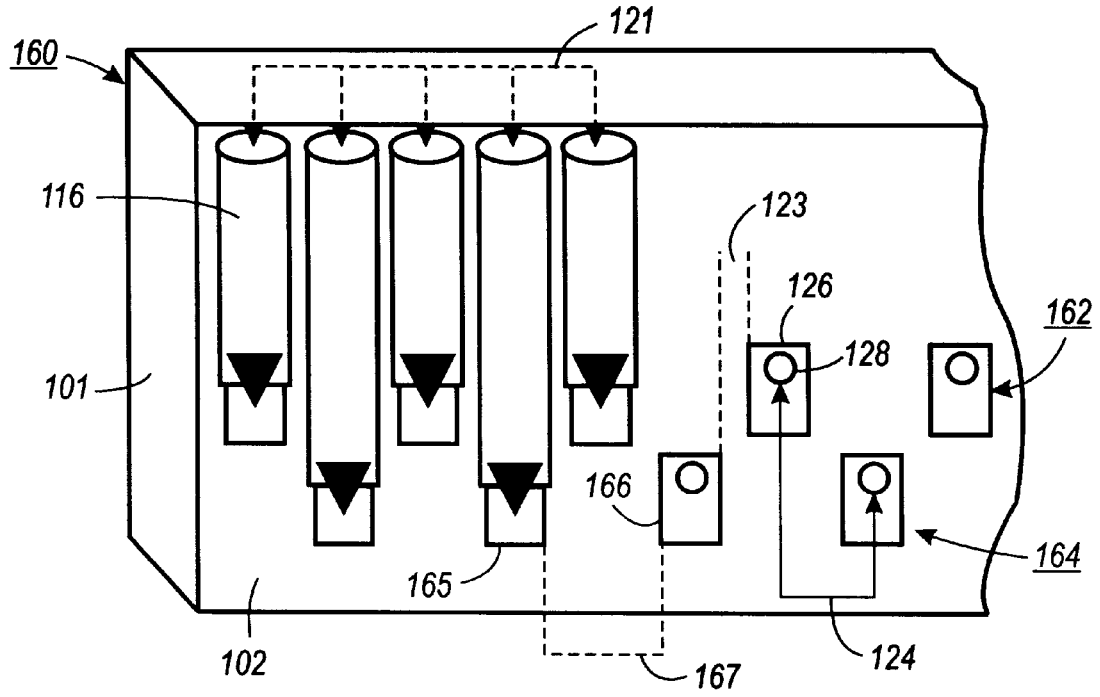
FIG. 9 is a schematic enlarged view of a portion of the first head member of FIG. 8 showing a first arrangement of offset conductive pads with conductors attached thereto.

FIG. 9 illustrates a portion 160 of writing head 150 having first and second rows 162 and 164, respectively, of conductive pads. Each conductive pad 126 is the same size as the conductive pads shown in FIG. 3. Within each row, the interpad distance 167 between any two adjacent pads 165 and 166 is significantly increased over the interpad distance 123 of writing head 100 of FIG. 3, while the interpad distance between two consecutive pads 166 and 126 and the center-to-center distance between two consecutive pads 166 and 126 remain the same as that in FIG. 3. Conductors 116 are positioned with their center-to-center distance 121 equal to the center-to-center distance shown in FIG. 3. It can be seen that the pad arrangement of writing head 150 illustrated in FIG. 9 does not result in an increased pitch; however, the increased interpad distance 167 within each row promotes the ability to join two writing head sections, a process which is described in more detail below.

Figure 10:
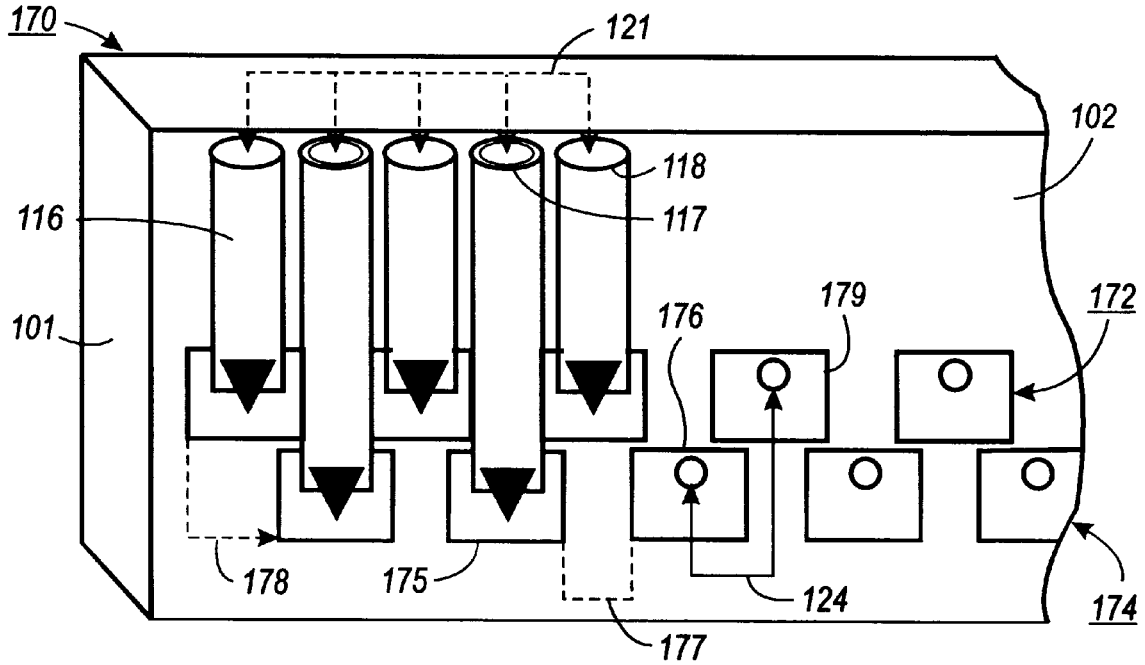
FIG. 10 is a schematic enlarged view of a portion of the first head member of FIG. 8 showing a second arrangement of offset conductive pads with conductors attached thereto.

FIG. 10 illustrates portion 170 of writing head 150 showing a different arrangement of conductive pads 156 of FIG. 3 in first and second rows 172 and 174, respectively. Each conductive pad 175 is twice the size of conductive pad 126 shown in FIG. 3. In addition, each pad in second row 174 is offset from a preceding pad in first row 172 by a distance 178. As a result, the interpad distance between two consecutive pads 176 and 179 in first and second rows respectively is eliminated. Within each row, the interpad distance 177 between any two adjacent pads 175 and 176 is twice the distance of the interpad distance 123 of writing head 100 of FIG. 3. The center-to-center distance 124 between two consecutive pads 176 and 179 remains the same as that in FIG. 3. Conductors 116 are positioned with their center-to-center distance 121 equal to the center-to-center distance shown in FIG. 3. Because conductors extending to pads in second row 174 pass over pads in first row 172, these conductors are insulated, while conductors attached to pads in first row 172 may be bare wire. It can be seen that the pad arrangement of writing head 150 illustrated in FIG. 10 also does not result in an increased pitch; however, the smaller pad size 126 illustrated in FIGS. 3 and 9 requires a high degree of accuracy for positioning a conductor for bonding to the pad; the increased pad size of the pads in the arrangement illustrated in FIG. 10 allows an extra tolerance for positioning each conductor. As with the arrangement illustrated in FIG. 9, the interpad distance 177 within each row in the arrangement of FIG. 10 also promotes the ability to join two writing head sections.

Figure 11:
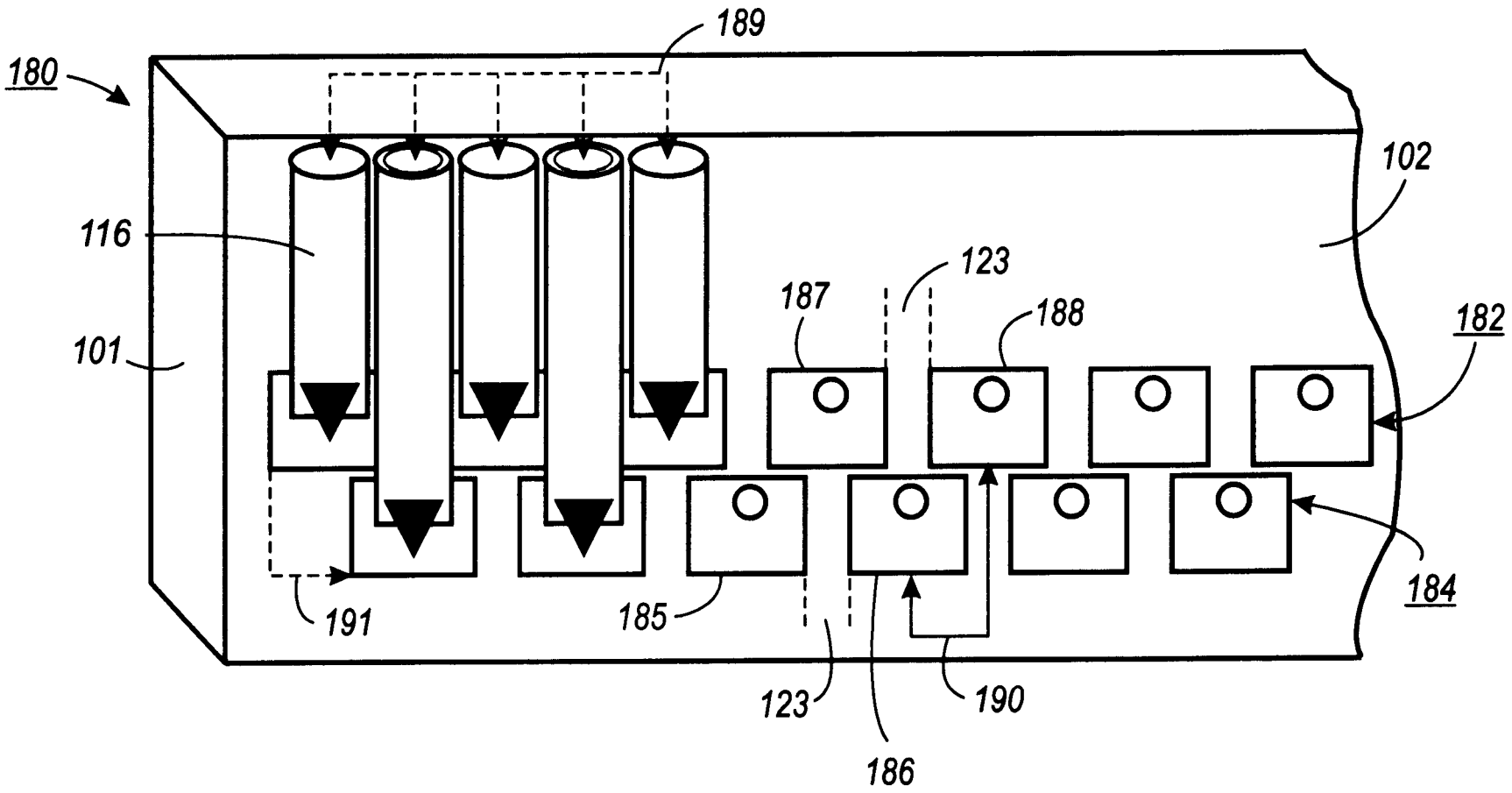
FIG. 11 is a schematic enlarged view of a portion of the first head member of FIG. 8 showing a third arrangement of offset conductive pads with conductors attached thereto.

FIG. 11 illustrates portion 180 of writing head 150 showing a different arrangement of conductive pads 156 of FIG. 3 in first and second rows 182 and 184, respectively. The size of each conductive pad 188 is increased by fifty percent (50%) over the size of the conductive pad 126 shown in FIG. 3. In addition, each pad in second row 184 is offset from a preceding pad in first row 182 by a distance 191. As a result, the interpad distance between two consecutive pads 185 and 187 is eliminated. Within each row, the interpad distance 123 between any two adjacent pads 185 and 186 is the same distance as the interpad distance 123 of writing head 100 of FIG. 3. The center-to-center distance 190 between two consecutive pads 186 and 188 is smaller than the center-to-center distance 124 in FIG. 3. Conductors 116 are positioned with their center-to-center distance 189 smaller than the center-to-center distance 121 shown in FIG. 3 and therefore these conductors have a smaller diameter than those shown in FIGS. 9 and 10. As with the pad arrangement in FIG. 10, every other conductor in the writing head of FIG. 11 is insulated because conductors extending to pads in second row 184 pass over pads in first row 182. It can be seen that the pad arrangement of writing head 150 illustrated in FIG. 11 results in a writing head having an increased pitch over the writing head of FIG. 3 and over the writing heads produced using pad arrangements in either FIGS. 9 or 10. Moreover, the increased pad size of the pads in the arrangement illustrated in FIG. 11 also allows an extra tolerance for positioning each conductor for attachment to its respective pad.

4. A Writing Head Having Two or More Parallel Rows of Nibs.

Figure 12:
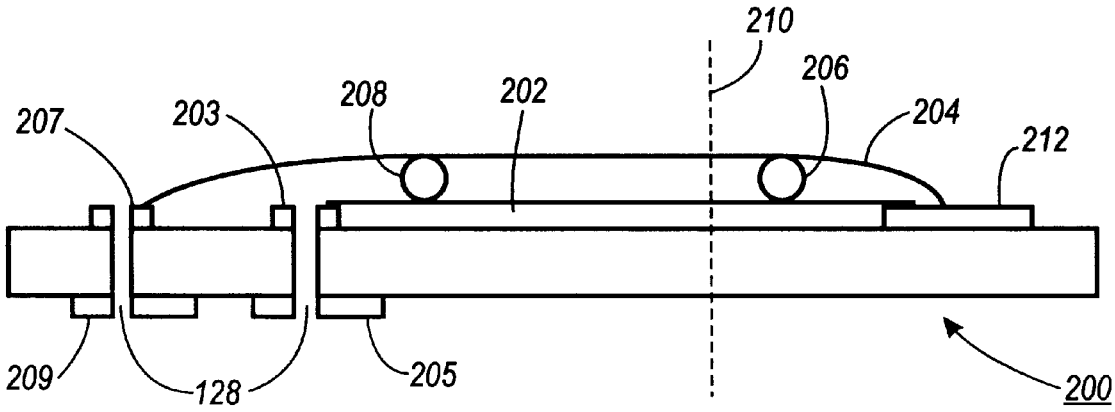
FIG. 12 is a side view of working substrate 200 from which the writing head of the present invention is made, showing the use of insulating spacers to separate conductors into two distinct planes.
Figure 13:
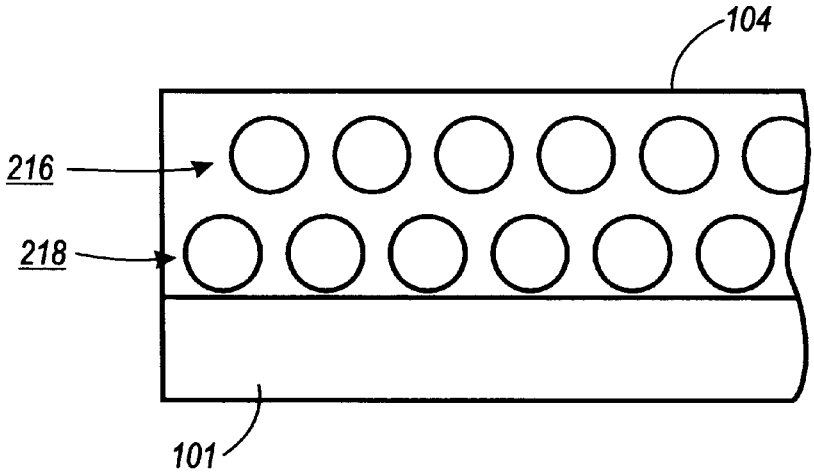
FIG. 13 is a schematic top view of a portion of a writing head showing a portion of the two planes of nibs in the nib line formed according to the structure of FIG. 12.

FIGS. 12 and 13 illustrate another embodiment of writing head 150 of FIG. 8. In this embodiment, the conductors that are attached to the two rows 156 of conductive pads are separated into two parallel planes that form two parallel lines 216 and 218 of nibs. In FIG. 13, lines 216 and 218 of nibs are electrically biased as a single nib line for writing a single scan line of the image. Or alternatively, lines 216 and 218 of nibs may be electrically biased as two distinct nib lines for writing a two scan lines of the image, provided that the spacing between adjacent nibs is adjusted from that shown in FIG. 13 to provide complete image coverage for each scan line.

FIG. 12 shows a side view of substrate 200 during the manufacture process for producing the writing head with two parallel lines of nibs. Bonding area 212 near the top edge of substrate 200 (at the right of the drawing) is permanently attached to substrate 200 and is used as an area to bond one end of each conductor. At the conclusion of the manufacturing process, substrate 200 and all of the conductors are cut at line 210, exposing the nib line of the writing head; after the cut, the portion of substrate 200 including the attached conductors and nib line becomes head member 101. In the description and drawings of the present invention, head member 101, which is part of a completed writing head, is distinguished from substrate 200 which is the working substrate used during the manufacturing process of the writing head.

Near the bottom edge of substrate 200 (at the left of the drawing), conductive pads 203 and 207 are paired with conductive pads 205 and 209 respectively, with a conductive via 128 extending through each of the pair of conductive pads and through substrate 200. One end of conductor 202 is shown attached to bonding area 212 and the other end is attached to conductive pad 203 in the first (upper) row of conductive pads.

Insulating spacers 206 and 208 are positioned on top of the conductors that have been attached to the first row of conductive pads, as represented by conductor 202 in FIG. 12, and are placed in a middle region of the top, or front, surface of substrate 200, between the conductive pads and bonding area 212, and extending the full length of substrate 200, parallel with bonding area 212. One end of conductor 204 is then attached to bonding area 212, and the other end passes over insulating spacers 206 and 208 and is attached to conductive pad 207 in the second (lower) row of conductive pads. Use of the spacers effectively separates the conductors, as exemplified by conductors 202 and 204, into two sets that form two parallel planes. After each conductor in the second set of conductors has been attached to a respective conductive pad in the second (lower) row of conductive pads, the second head member is attached, and the assembly is cut at line 210 to form the nib line of the writing head.

FIG. 13 shows a portion of the top view of a writing head having the characteristics shown in FIG. 12. Lines 216 and 218 of nibs are positioned in two parallel planes spaced a distance 214 apart. The diameter of spacer 206 in FIG. 12 is the same as the diameter of spacer 208, causing conductor 204 to lie in a plane parallel to and spaced a distance 214 from conductor 202 when conductor 204 passes over spacers 206 and 208. The placement of spacers 206 and 208 relative to top surface 102 as well as the distance between them are selected to ensure that the two lines of nibs are substantially parallel to each other and are spaced apart by distance 214 It the nib line formed at cut line 210. It can be seen that by placing spacer 206 above (to the left in FIG. 12) cut line 210, it does not become a permanent part of the writing head. In addition, spacer 208 may be placed on the first set of conductors in a position relative to the top surface of substrate 200 to ensure that conductor 204 passes over conductive pad 203 in the first row of conductive pads without touching the pad, as illustrated in FIG. 12. This allows noninsulated wire to be used for both sets of conductors without the risk of electrical shorting.

5. A Writing Head With Three or More Rows of Offset Conductive Pads.

As noted above, the design of writing head 150 of FIG. 8 having the pad arrangement shown in FIG. 11 with two offset rows of conductive pads allows for a writing head of increased pitch as compared to the embodiments shown in FIGS. 3, 9 and 10. In general, the pitch of writing head 150 as illustrated in FIG. 11 is further increased by adding conductors connected to one or more additional rows of conductive pads in which the pads in each row are offset from a row positioned above or below it in a manner that maintains a fixed center-to-center spacing between consecutive conductive pads.

Figure 14:
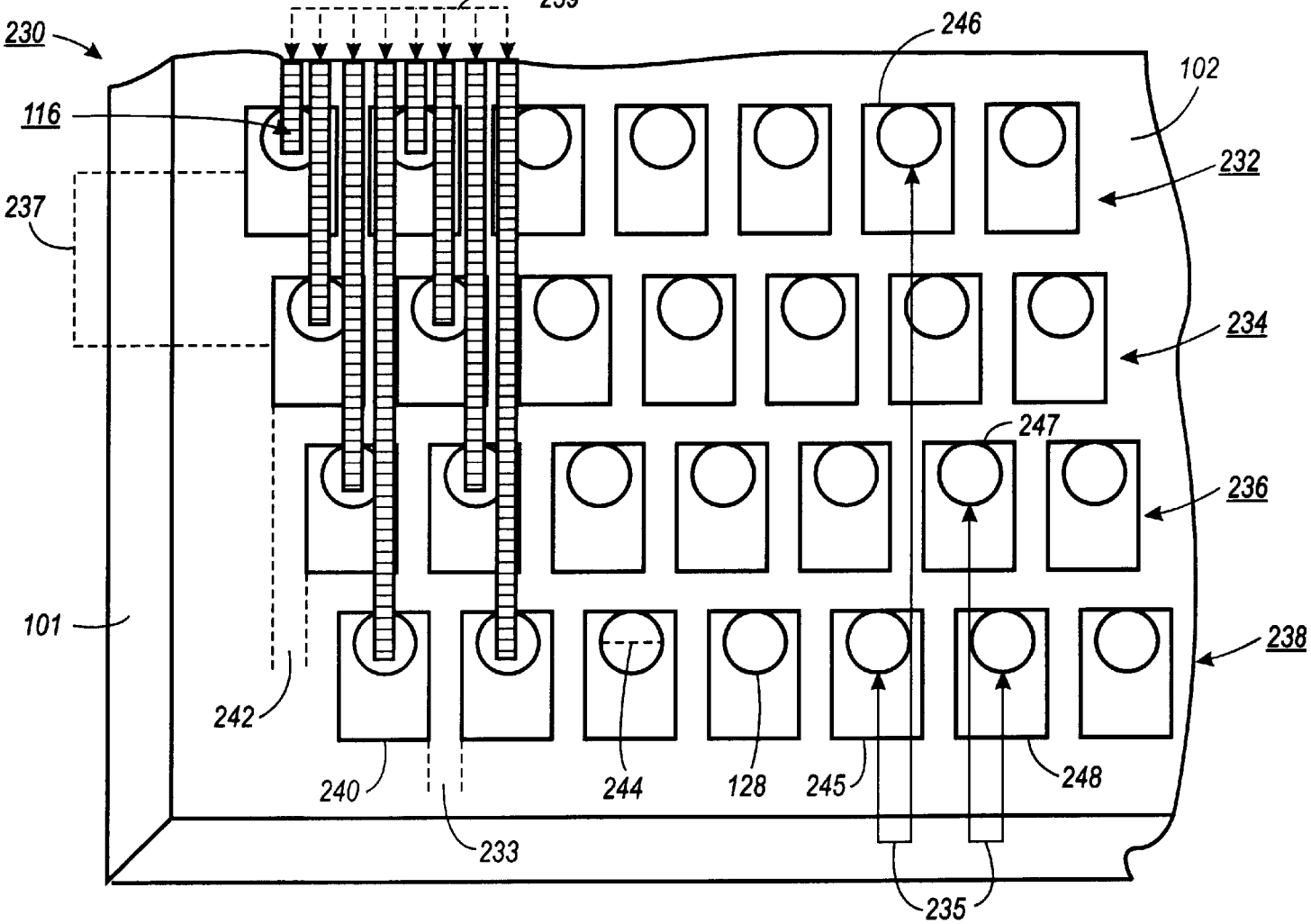
FIG. 14 is a perspective front view of a portion of the first head member of the writing head of the present invention showing a fourth arrangement of conductive pads and conductors in four offset rows.

For example, FIG. 14 illustrates a portion of writing head 230 having conductors 116 attached to conductive pads arranged in four offset rows of conductive pads 232, 234, 236 and 238. A conductive pad in any one of rows 234, 236 and 238 is offset from the prior consecutive conductive pad positioned in the row above it by fixed distance 242 which is equivalent to the center-to-center spacing 239 of the conductors, and which is also equivalent to $$\frac{1}{\text{pitch}}.$$

Fixed offset distance 242 along the x-axis causes the conductive pads in each row to maintain a consistent interpad distance 233 and center-to-center spacing 235 between consecutive conductive pads, such as shown in FIG. 14 between consecutive conductive pads 245 and 246 and between consecutive pads 247 and 248. Conductors 116 are each connected in consecutive order to a respective consecutive conductive pad such that every fourth conductor is connected to a respective conductive pad in the same row; this type of connection pattern is referred to herein as "an alternating conductor arrangement".

Figure 15:
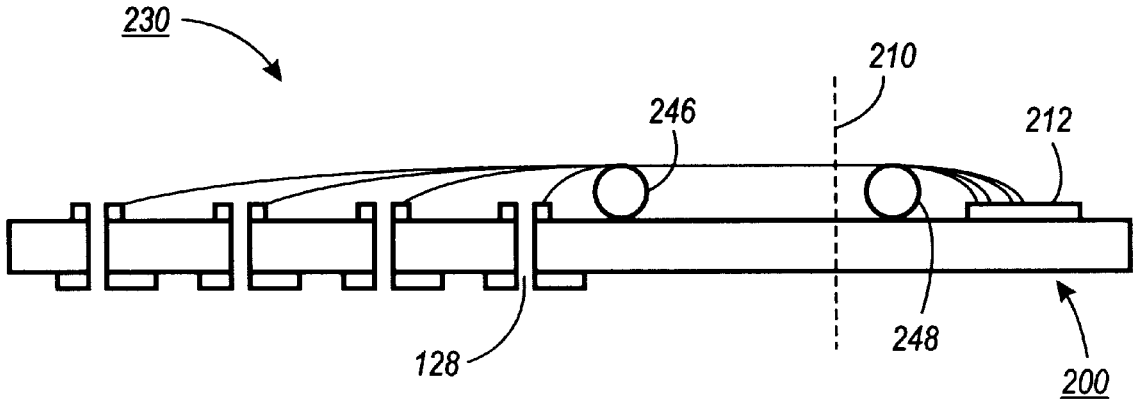
FIG. 15 is a side view of working substrate 200 from which the writing head of the present invention is made, showing the use of insulating spacers to remove conductors from the top surfaces of conductive pads they pass over.

Each conductor of conductors 116 must make electrical contact only with the conductive pad it is attached to, and therefore must be insulated from, or prevented from contact with, conductive pads in other rows that it may be positioned over. If the pitch of the writing head permits a larger diameter wire, insulated wire may be used for all wires to prevent electrical shorting. Alternatively, an insulated spacer may be placed between the top surface 102 of first head member 101 and conductors 116 to space conductors 116 from surface 102. FIG. 15 illustrates this feature, showing a side view of substrate 200 during the manufacture process for producing writing head 230. As with the view shown in FIG. 12, bonding area 212 in FIG. 15 near the top edge of substrate 200 (at the right of the drawing) is permanently attached to substrate 200 and is used as an area to bond one end of each conductor. At the conclusion of the manufacturing process, substrate 200 and all of the conductors are cut at line 210, exposing the nib line of the writing head. Near the bottom edge of substrate 200 (at the left of the drawing), four rows of conductive pads are permanently attached to the top surface of substrate 200, with each conductive pad being paired with conductive pads on the bottom surface; each conductive pad has a conductive via 128 extending through each of the pair of conductive pads and through substrate 200. Insulating spacers 246 and 248 are positioned in a middle region of the top surface of substrate 200, between the conductive pads and bonding area 212, and extending the length of substrate 200 such that all conductors 116 pass over spacers 246 and 248. Four consecutive conductors are shown but not individually referenced. One end of each of the four conductors is attached to bonding area 212. The four conductors are consecutively attached at the other end, as shown in FIG. 14, to consecutive ones of four conductive pads in four offset rows passing over spacers 246 and 248.

Figure 16:
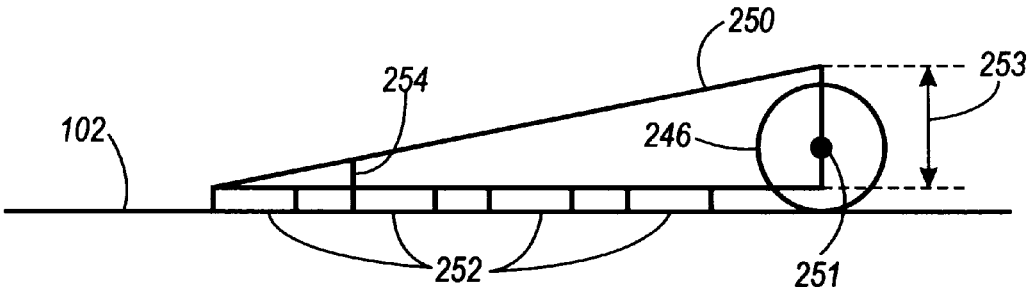
FIG. 16 is a diagram illustrating a method for calculating the size of the insulating spacer illustrated in FIG. 15.

Spacer 246 has a diameter sufficient to lift the conductors that are attached to conductive pads in the fourth (lowest, or last) row of pads away from the surface of substrate 200 and away from conductive pads in the first three rows of pads that these conductors pass over, in order to maintain an acceptable gap above those pads, thereby preventing any one conductor of conductors 116 from coming into electrical contact with a conductive pad over which it is positioned as a result of its connection to its respective conductive pad. FIG. 16 generally illustrates how a minimum diameter of spacer 246 may be determined. In order for a conductor (not shown) to clear a conductive pad in the third of four offset rows of conductors 252 by a minimum distance 254, spacer 246 must have a diameter at least equal to the length 253 of side 251 of right triangle 250, which extends from the position of spacer 246 to the fourth row of conductive pads 252. Insulating spacers 246 and 248 are shown as round in the drawings; and are shown as a pair of spacers, in contrast to a single spacer of another shape, such as rectangular or square.

With reference again to FIG. 14, in an embodiment of writing head 230 that has been constructed, each conductive pad 240 has dimensions of 20 mils wide by 40 mils long and has a conductive via 128 having diameter 244 of 14.5 mils. Conductive pads are positioned 6 mils apart in a single row, creating a center-to-center spacing of 26.6 mils between adjacent pads in a row. Each row of conductive pads is positioned 10 mils from the row above or below it, which creates a center-to-center distance 237 between conductive pads in different rows of 50 mils in the y, or vertical, direction with respect to top surface 102 of head member 101. Offset distance 242, and center-to-center distance 239 between conductors, is 6.6 mils, resulting in a writing head having a pitch of $$\frac{1}{6.6 \text{ mils}},$$

or approximately 150 spots per inch. Insulating spacers 246 and 248 are used in this embodiment and each has a diameter of 14 mils, which is sufficient to maintain the minimum gap necessary between a conductor and conductive pads in other rows positioned under it to avoid electrical shorting.

6. A Writing Head With Two Rows of Nib Lines and Three or More Rows of Offset Conductive Pads.

Figure 17:
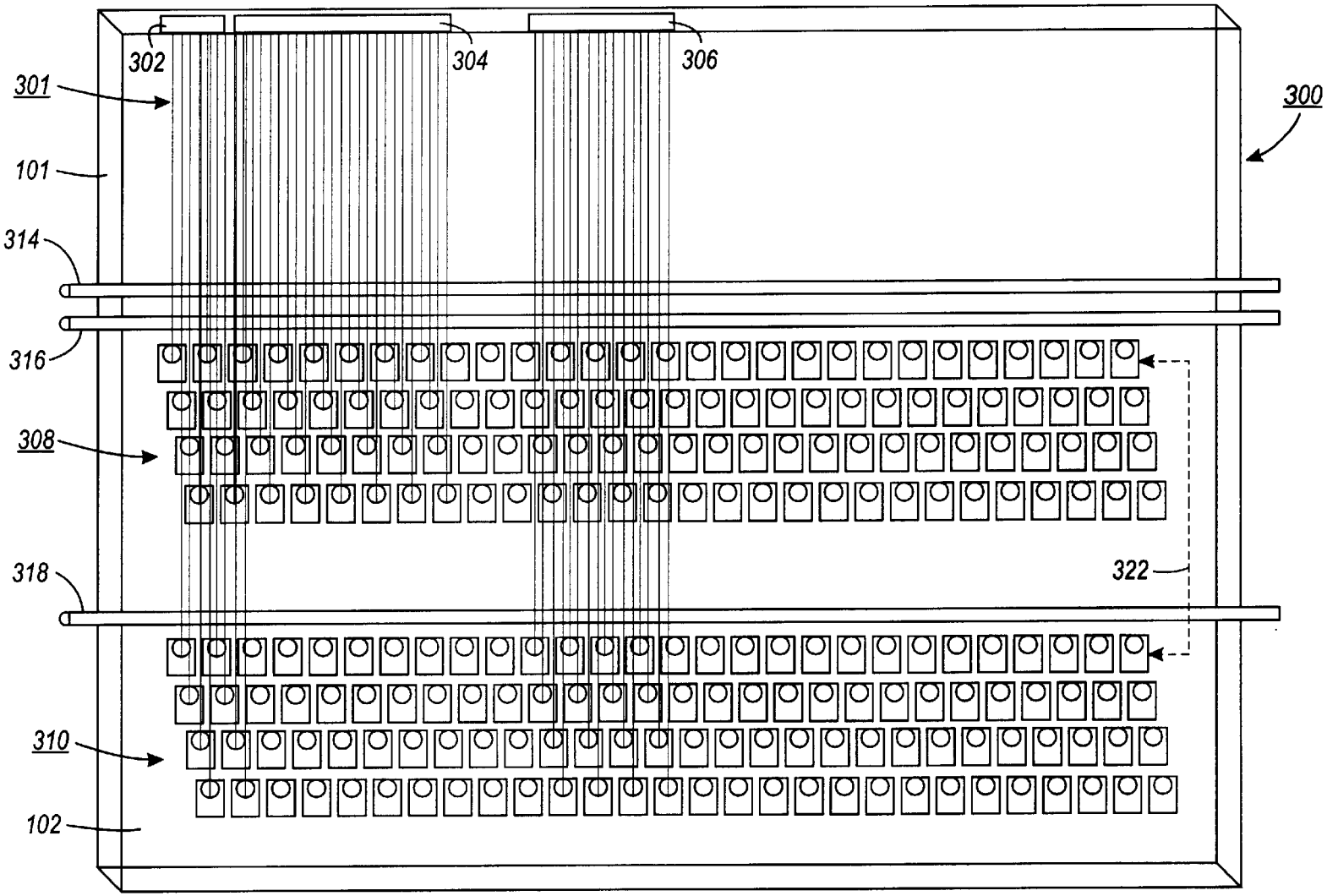
FIG. 17 is a diagrammatic perspective front view of the first head member of an embodiment of the writing head of the present invention showing the connection pattern of conductors to conductive pads.
Figure 18:
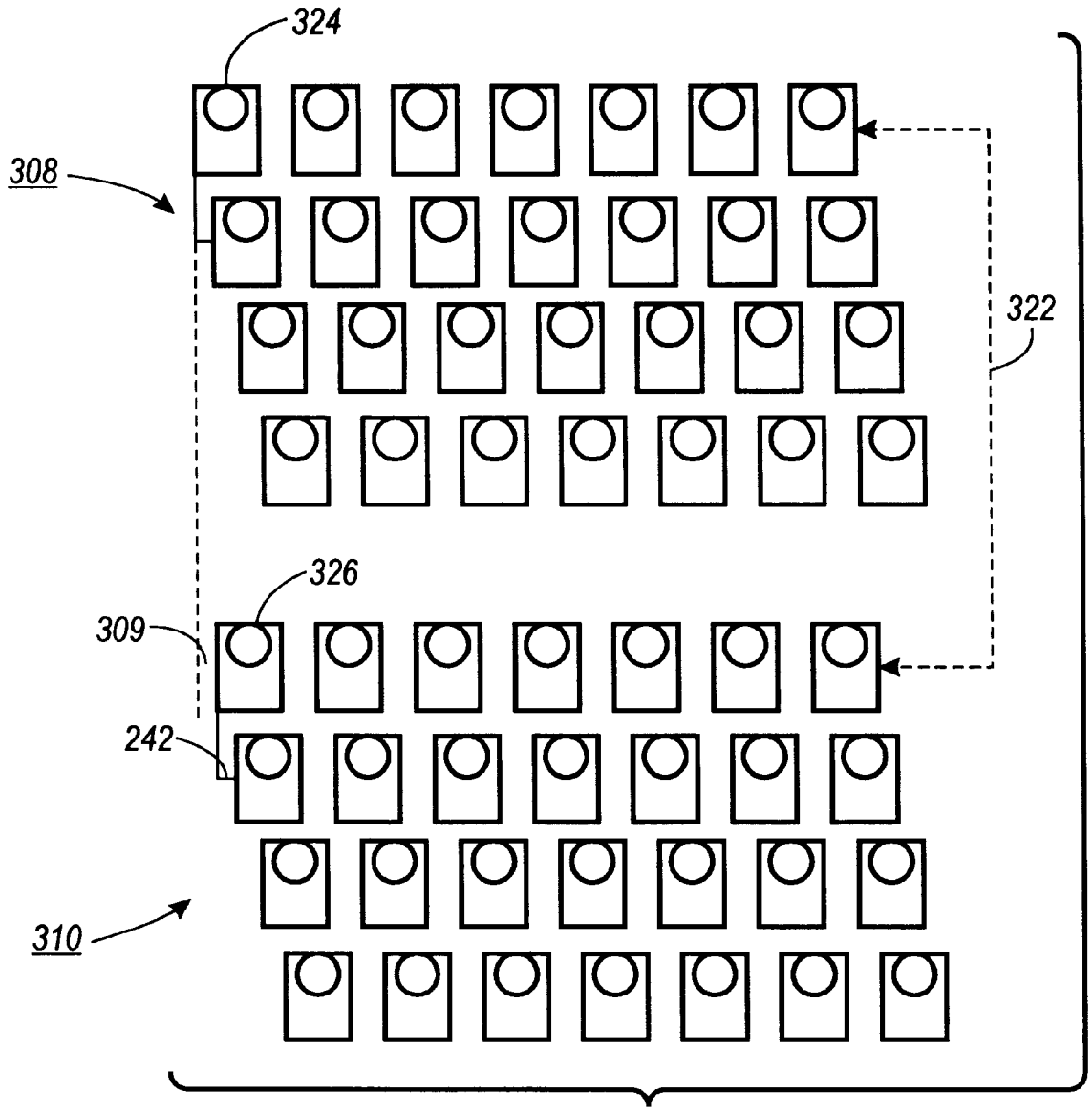
FIG. 18 diagrammatically illustrates the spacing requirements of the arrangement of conductive pads in the embodiment illustrated in FIG. 17.
Figure 19:
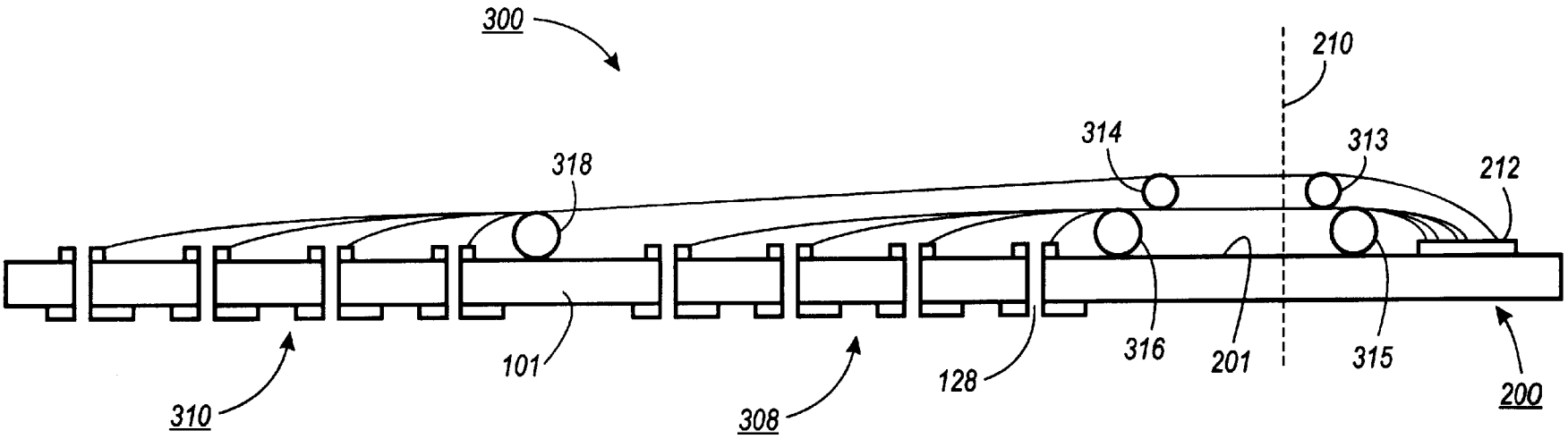
FIG. 19 is a side view of the working substrate used to produce the first head section of the writing head of FIG. 17, taken laterally through the first head member at a line passing through group 302 of conductors, showing the placement of the insulating spacers.

The characteristics and features illustrated in FIGS. 12–16 may be combined into still another embodiment of the writing head of the present invention. This embodiment combines the advantages of the increased pitch achieved by the offset conductive pad arrangement of FIG. 14 with the ability to create two rows of nibs by using insulating spacers between two sets of conductors. The combined result is to produce a writing head having a pitch of twice as many spots per inch as in writing head 230 of FIG. 14 by doubling the number of conductors that may be attached to conductive pads on a head member having the same physical size. FIGS. 17, 18 and 19 illustrate this embodiment.

FIG. 17 shows first head member 101 of writing head 300, which is shown as incomplete in order to illustrate features of connecting the conductors to the conductive pads. For purposes of illustrating the arrangement and connections of the conductors, the conductors shown in FIG. 17 are labeled as three groups 302, 304 and 306. Two sets 308 and 310 of four offset rows of conductive pads are attached to top surface 102 of head member 101; sets 308 and 310 are separated by vertical distance 322. Group 302 of conductors are shown attached to conductive pads in both sets 308 and 310 of pads; group 302 of conductors illustrates the appearance of a completed configuration of conductors when all conductors are attached to conductive pads on head member 101. Group 304 of conductors are attached to conductive pads only in set 308 of conductive pads, in an alternating conductor arrangement as previously shown in FIGS. 11 and 14; group 306 of conductors are attached to conductive pads only in set 310 of conductive pads.

Two insulating spacers 316 and 318 are positioned on top surface 102 of head member 101; spacer 316 creates a gap between top surface 102 and conductors attached to conductive pads in first set 308 of conductive pads, and spacer 318 creates a gap between top surface 102 and conductors attached to conductive pads in second set 318 of conductive pads. FIG. 19 is a side view of the working substrate 200 of writing head 300 during the manufacture process that illustrates the placement of spacers 316 and 318. Spacers 316 and 318 perform the function previously discussed with respect to FIG. 15 of preventing conductors from having contact with conductive pads over which they are positioned but to which they are not attached. As in FIG. 15, additional insulating spacer 313 is positioned above cut line 210 (at the right of the figure) during manufacture of writing head 300 in order to cause the conductors to line in a plane substantially parallel to top surface 201 of substrate 200 in the region near cut line 210 where the nib line is formed.

Also shown in FIG. 17 is insulating spacer 314 which is positioned on top of all conductors attached to set 308 of conductive pads, including all conductors in group 304 and those conductors in group 302 that are attached to conductive pads in set 308. Insulating spacer 314 serves the function previously discussed with respect to FIGS. 12 and 13 of forming two rows of nibs in the nib line of writing head 300 by separating the conductors into two sets that lie in distinct and separate planes, conductors attached to set 308 of conductive pads lie in a first plane and conductors attached to set 310 of conductive pads lie in a second plane parallel to the first plane. FIG. 19 shows the positioning of insulating spacer 314 and its companion spacer 313 positioned above cut line 210.

Nib line 301 (FIG. 17) of writing head 300 has two rows of nibs offset from each other in the manner shown in the top view of the writing head of FIG. 13. Note that in FIG. 17 insulating spacers 314, 316 and 318 are shown as all having the same size for illustrative purposes only; as previously discussed, the size of spacer 314 is related to the image forming factors described above in the discussion accompanying FIG. 33, and the size of spacers 316 and 318 is related to a minimum size needed to achieve the proper gap between the conductive pads and conductors, as described in the discussion accompanying FIG. 16. Thus, insulating spacer 314 may be the same size as spacers 316 and 318 in a particular configuration of writing head 300, or may be larger or smaller; FIG. 19 illustrates insulating spacers 313 and 314 as being smaller than the insulating spacers 315, 316 and 318. Note also that the insulating spacers in FIG. 17 are not necessarily drawn to show their actual scale with respect to the conductors and conductive pads.

FIG. 18 shows a schematic view of the arrangement of sets 308 and 310 of conductive pads. Note that distance 322 in FIG. 18 between sets 308 and 310 of conductive pads is not drawn at the same scale as in FIG. 17 to conserve space in the figure. The conductive pads in each set 308 and 310 of pads are arranged with respect to each other as shown in FIG. 17, with each row being offset from the row above it by distance 242. In order to produce nib line 301 (FIG. 17) having a first row of nibs offset from the second row of nibs, as shown in FIG. 13, the first pad 326 in set 310 of conductive pads is offset from first pad 308 in set 310 of conductive pads by distance 309, which is approximately half of distance 242.

When writing head 300 is constructed using the exemplary dimensions given above with respect to the conductive pad arrangement shown in FIG. 14, each of the two sets of conductors attached to sets 308 and 310 of conductive pads, respectively, produces a row of nibs having a pitch of approximately 150 spots per inch. In combination, the two rows of nibs produce a single nib line having a pitch of 300 spots per inch. In FIG. 18, distance 242 is 6.6 mils, as it was in the exemplary dimensions given for the conductor arrangement of FIG. 14, and distance 309 is 3.3 mils. The embodiment of FIG. 17 uses 39–40 gauge nickel wire having a diameter of from 3.3–3.6 mils. Insulating spacers 315, 316 and 318 (FIG. 19) have a diameter of 14 mils, and insulating spacers 313 and (FIG. 19) 314 have a diameter of 4 mils. In addition, second set 310 of conductive pads is attached to surface 102 of head member 101 a distance 322 (FIGS. 17 and 18) of 430 mils below first set 308 of conductive pads.

7. A Writing Head Composed of Joined Writing Head Sections.

The writing head of the present invention, as illustrated by the various embodiments of writing heads 100, 150, 230 and 300, has an overall length dimension (as measured in the x direction shown in FIG. 8) that is theoretically limited only by the ability to manufacture first head member 101 with the conductive pads attached. As described below, printed circuit board (PCB) technology is used to form the conductive pads on a working substrate that becomes head member 101, and limitations may exist in current PCB technology that determine the length of the substrate that may be used. The capability to produce longer writing heads than can be currently manufactured, or a desired reduction in manufacturing costs, or both, can be attained by constructing the writing head of the present invention to a desired length from individual smaller sections that have been joined together. This involves constructing the working substrate that forms the unitary first head member, from which the writing, head will be manufactured, from individual joined sections before attaching the conductors to the head member. Thus, the individual sections must be joined in such a way as to maintain certain parameters of the arrangement of the conductive pads.

In particular, with reference to FIGS. 3 and 5, multiple sections of head member 101 with conductive pads 106 and 108 attached to top and bottom surfaces 102 and 103, respectively, may be joined together by a process described below to form a head member of the desired length before conductors 116 are attached to the conductive pads. The key to joining individual head member sections is to preserve the center-to-center spacing 124 (FIG. 3) between adjacent conductive pads in the same row within a certain predetermined and acceptable tolerance.

With respect to embodiments of the writing head that have a single row of conductive pads, as illustrated in FIG. 3, or multiple rows of conductive pads that are not offset, preparing each end of two head members 101 for joining requires a straight cut through each head member along its width dimension (the dimension parallel with the lengthwise extent of the conductors); this cut produces an edge much like that of edge 105 shown in FIG. 3, but the cut is positioned a distance away from the last (or first) conductive pad that is half of the distance between the conductive pads, within a certain predetermined acceptable tolerance, such that when joined, the center-to-center spacing between the last conductive pad on the first head member and the first conductive pad on the second head member is substantially maintained. It will be appreciated that joining sections of head member 101 of FIG. 3 when configured with conductive pads spaced at a minimal interpad distance of 3 mils apart requires extremely tight tolerances in making this straight cut; moreover, if the smallest conductive pads of 10 mils are used, this allows little or no margin of error in the placement of the conductive pads when the conductors are attached, since the small pads require that each conductor be accurately placed for attachment. However, in embodiments of the writing head of FIG. 3 having a lower pitch and using larger pads with increased interpad spacing, joining head member sections by the method described below is a very satisfactory solution to the problem of producing longer writing heads.

The use of multiple offset rows of conductive pads that have an increased interpad spacing in the pad arrangement significantly facilitates the joining process by reducing the precision required, and thereby increasing the predetermined tolerances allowed, to cut the end of a first head member for joining with the end of a second head member. While it is desirable to maintain the center-to-center spacing between adjacent pads that occur across the gap produced by the joining process, using an increased pad size only requires that the second of two adjacent pads that occur at the gap of two joined sections is positioned so that a conductor may be bonded to some part of the surface of the pad. Thus the center-to-center spacing of these adjacent pads that occur at a gap may not be exactly the same as the center-to-center spacing of a pair of adjacent pads that occur remote from the gap, but that spacing is within a predetermined, acceptable tolerance that allows for a conductor to land on the pad for bonding thereto. This allowable acceptable tolerance in the cuts made at the lateral edges of the substrates to be joined allows for head members to be constructed of virtually any length.

Figure 20:
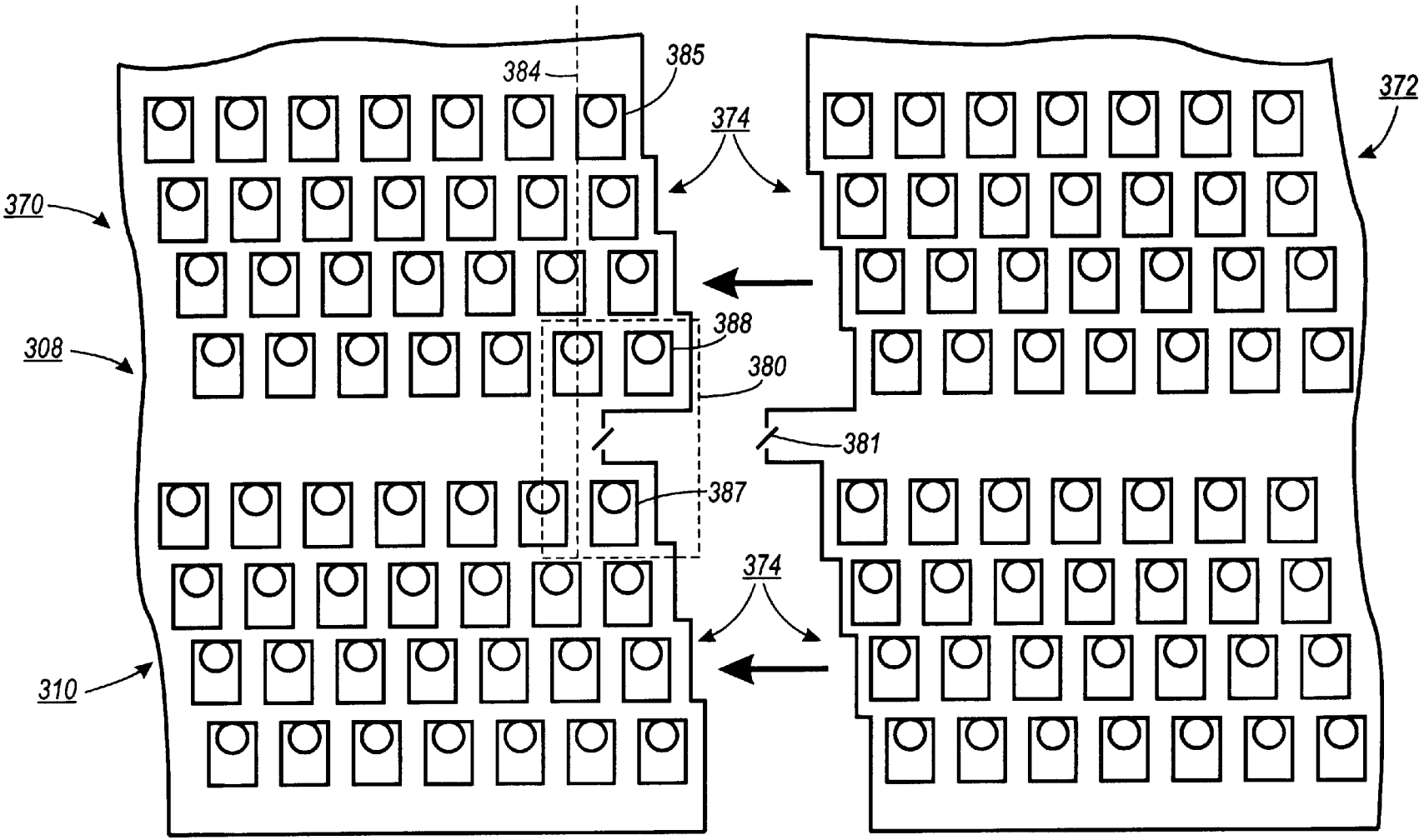
FIG. 20 diagrammatically illustrates the stepped cut of the edges of head member sections that are joined to form a unitary first head member of the writing head, according to the embodiment shown in FIGS. 22 and the method shown in FIG. 32.

FIG. 20 is a partial front view of two portions 370 and 372 of two head members 101 of writing head 300 of FIG. 17. Each head member has two sets 308 and 310 of four offset rows of conductive pads. The vertical distance between sets 308 and 310 is shortened in comparison to the distance shown in FIG. 17, to make the figure more compact; the shortened distance is indicated by line 381 in FIG. 20. The end of each head member that is to be joined to an end of another head member is cut in a stepped cut 374 that follows the contour of the offset arrangement of the pads. These ends are referred to as lateral complementary edges of head member sections 370 and 372 since they have the same cut and fit together in a complementary fashion; when these edges are joined, they are referred to as abutting complementary lateral edges.

Figure 21:
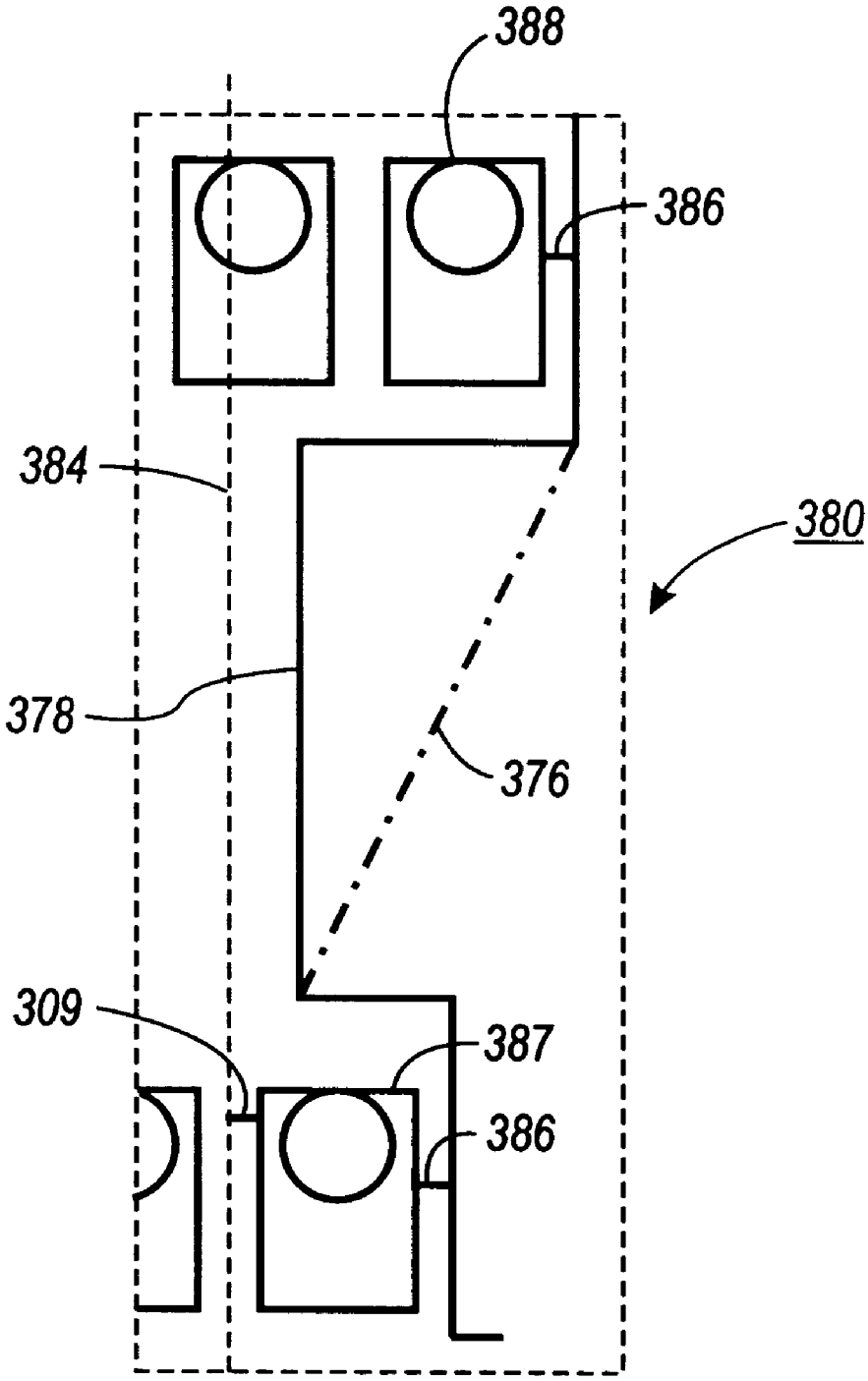
FIG. 21 illustrates an enlarged portion of FIG. 20 showing measurement relationships that illustrate predetermined tolerances for making the stepped cut of FIG. 20.

Rectangular region 380 is enlarged in FIG. 21 to illustrate the distances that are of interest in computing the predetermined tolerances at the edges and for making stepped cut 374; the distance between the two sets of conductive pads is shown expanded in FIG. 21. It can be seen in FIG. 20 that dashed line 384 aligns with conductive pad 385 which is the last pad in the first row of set 308 of conductive pads. As described in the discussion accompanying FIG. 18, first pad 387 in the first row of pads in set 310 of conductive pads is offset by distance 309 from conductive pad 385. Stepped cut 374 is preferably made at a distance 386 from the last pad in each row of pads; distance 386 is half of the interpad distance between the pads and may vary by a predetermined tolerance that is computed to allow a conductor having a fixed parallel spacing from a previous consecutive conductor to land on the next consecutive pad that occurs over the gap of the joint. Thus, in the case of connecting conductors to four offset rows of pads, the next adjacent conductive pad that occurs on the other side of a gap formed by joining two sections is actually the fourth consecutive conductor to be bonded; the predetermined tolerance that is allowed in distance 386 is a function of the pad size and the pitch of the writing head that accumulates over the span of these four consecutive conductors.

Note also in FIG. 21 that the cut 378 between the last row of pads in set 308 of conductive pads and the first row of conductors in set 310 of conductive pads is typically not an important consideration in shaping the cut of the lateral edges for joining. Cut 376 is an equally acceptable cut to use to form the contour of the complementary lateral edges.

In an embodiment of a writing head with joined head member sections constructed according to the dimensions and measurements given above with respect to writing head 230 of FIG. 14 and writing head 300 of FIG. 17, offset distance 309 is 3.3 mils and stepped cut distance 386 is 3 mils. Tolerances can be computed by taking into account the pad width of 20 mils and the interpad spacing of 6.6 mils.

Figure 22:
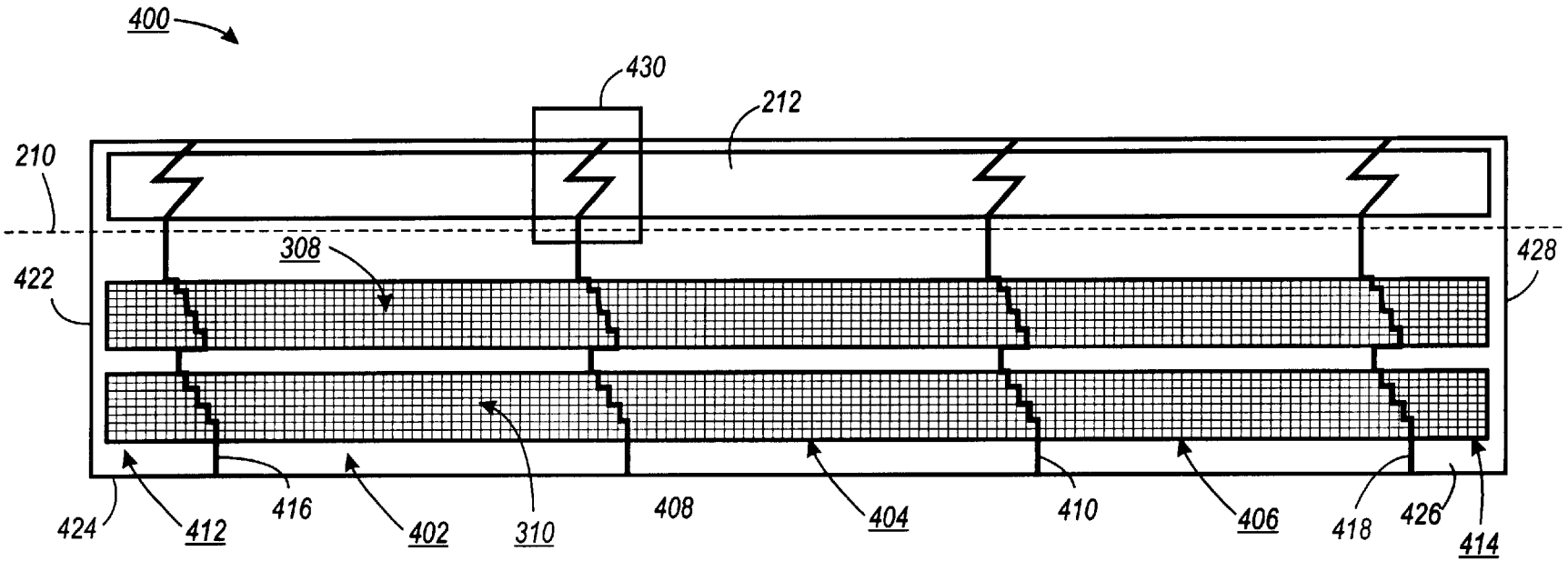
FIG. 22 is a front view of the back surface of the working substrate of a unitary first head member composed of head member sections joined together.

FIG. 22 shows a schematic front view of substrate 400 composed of joined substrate sections 402, 404 and 406, each having the characteristics of writing head 300 of FIG. 17; substrate 400 is shown during the manufacturing process, with each substrate section 402, 404 and 406 having bonding area 212, for bonding one end of the conductors and two sets 308 and 310 of conductive pads. After all conductors have been bonded to area 212 and the second head member has been added encapsulating the conductors, substrate 400 is cut at cut line 210 to form the nib line of the writing head. Each substrate section 402, 404 and 406 includes sets 308 and 310 of conductive pads attached to its top surface; sets 308 and 310 of conductive pads are represented in FIG. 22 as cross-hatched regions without distinct features of these offset rows of conductive pads, but it is understood that these conductive pads have the configuration shown in FIG. 17. Stepped cut lines 416, 408, 410, and 418, shown as thick lines for illustration purposes, show the contour of the ends of the individual substrate sections, as described in the discussion accompanying FIG. 20. Substrate 400 also includes end cap sections 412 and 414 which are smaller in width than sections 402, 404 and 406. End cap sections 412 and 414 are used for installing the completed writing head in an electrostatic marking device; conductors are typically not attached to these sections during manufacturing other than for test purposes, and any conductors that are attached do not extend over cut line 210 and thus do not form part of the nib line of the completed writing head. End cap sections 412 and 414 are shown as simple rectangular regions but edges 422, 424, 426 and 428 may have shapes suitable for being secured to fittings in the marking device to retain the writing head in its proper position.

Figure 23:
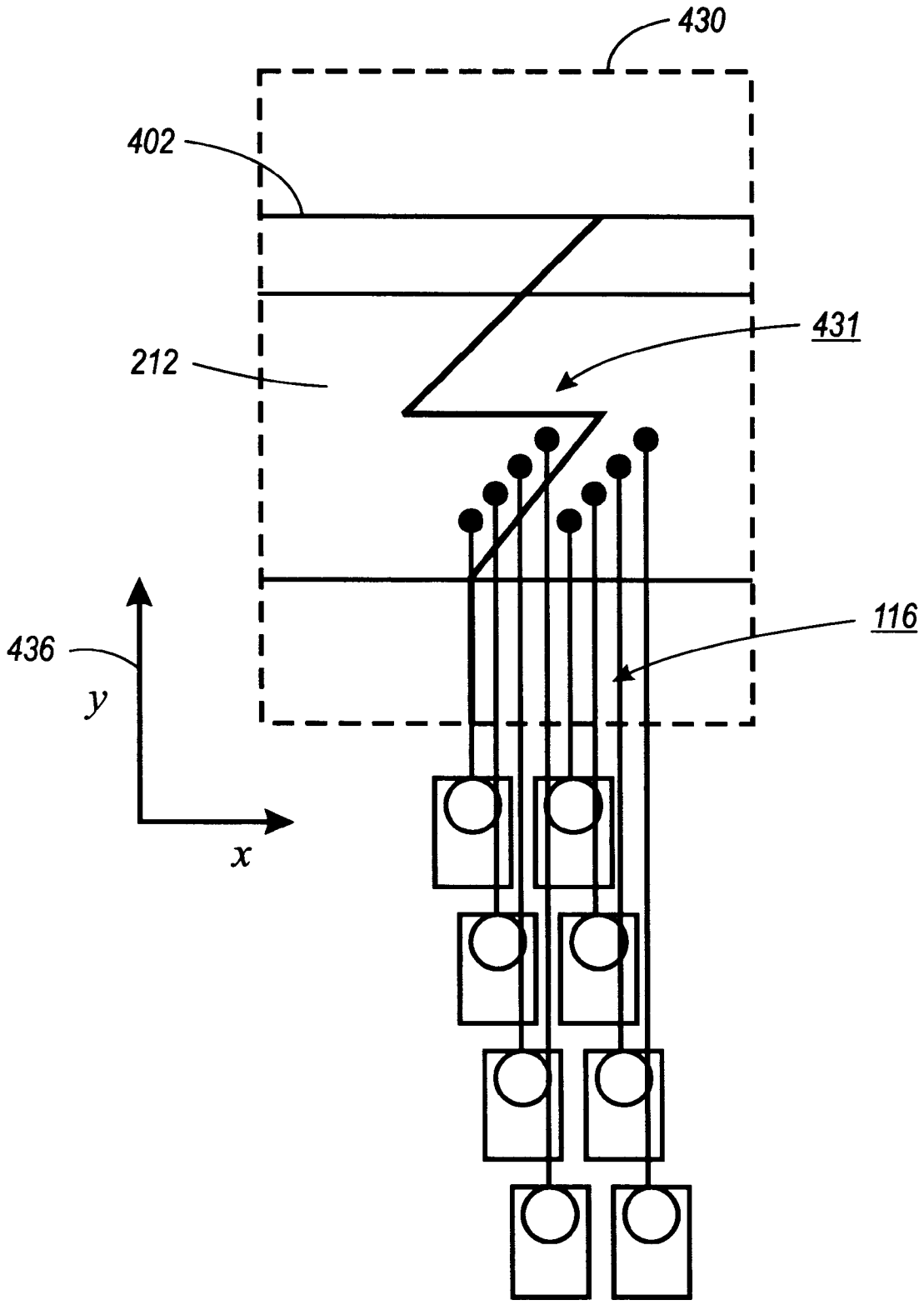
FIG. 23 illustrates an enlarged portion of FIG. 22 showing an example of a cutting pattern through bonding area 212 to accommodate the bonding of conductors thereto in a joined head member.

FIG. 23 is an enlarged view of rectangular region 430 of FIG. 22 which shows the detail of edge portion 431 of substrate 402 and 404 through bonding area 212. Also shown in FIG. 23 are conductors and conductive pads. Edge portion 431 is one of many examples of an edge configuration that is tailored to the arrangement of the conductors that results from the particular method used to bond the conductors to bonding area 212. An individual substrate section must have an edge cut through bonding area 212 that has a configuration that ensures that each conductor is bonded to an area of bonding area 212 and not to the gap between the head member sections that is necessarily formed during the joining process. The small gap between sections, represented as the black area of edge 431, is made of the material used for joining the sections (e.g., epoxy) and is not suitable for bonding a conductor. The actual edge configuration required depends on the manner in which the conductors are bonded to bonding area 212. In FIG. 23, one end of each of four consecutive ones of conductors 116 is bonded to bonding area 212 in a position that is an (x,y) displacement from the preceding adjacent conductor relative to axes 436; each set of four conductors forms a diagonal line of bonds, which are represented as small black circles. For this method of bonding, edge configuration 431 ensures that, for conductors positioned at the junction of two substrate sections, their ends avoid the gap region and fall in bonding area 212.

Writing head 300 illustrated in FIG. 17 may be constructed using a substrate that has the structure of substrate 400 of FIG. 22. The substrate sections with conductive pads attached are joined into a single unitary substrate 400 prior to bonding the conductors to the substrate. The joining process is described below. It can be seen that individual sections of substrates may each be cut to specific lengths and combined to form the desired length of the writing, head. Or, alternatively, multiple substrate sections each having a fixed length may be combined and joined to a substrate section of a special length that together form the total writing head length desired. To form a fifty-four (54) inch writing head, for example, three fourteen (14) inch sections may be combined with a twelve (12) inch section and end cap sections. Still another alternative is to form a substrate for manufacturing a writing head from fixed length substrate sections and attach conductors only to the portion that gives the desired nib line length. It can be appreciated that a writing head constructed of individual substrate sections offers great design flexibility, and may also offer significant cost savings when constructing, longer writing heads, over the construction of a writing head having a unitary working substrate.

8. Connecting a Writing Head to Image Driver Circuitry.

Figure 37:
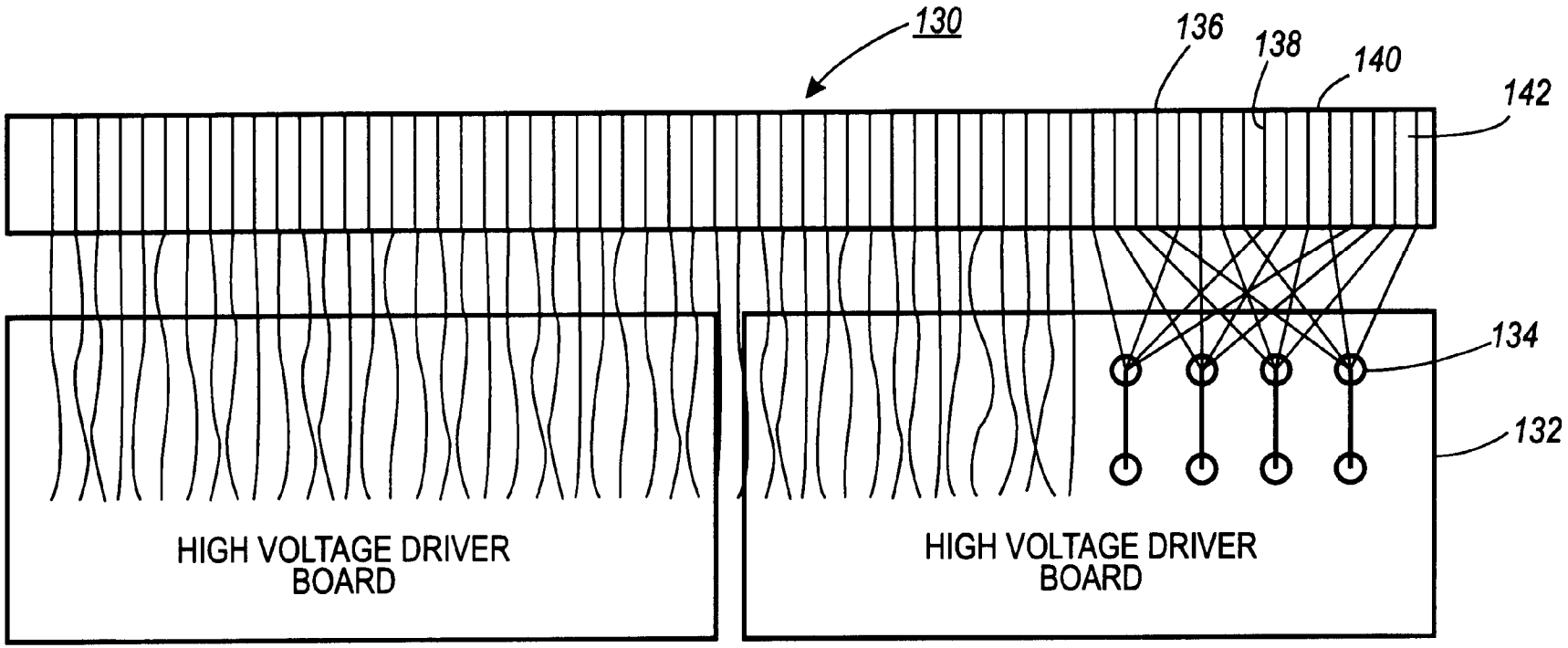
FIG. 37 (Prior Art)
FIG. 37, which is labeled as prior art, is a diagrammatic front view of a writing head produced according to the prior art method shown in FIG. 36 and illustrating a wire weaving process for connecting head conductors to high voltage driver boards.

The use of paired first and second surface conductive pads that are integral with one of the head members of the writing head facilitates a relatively simple and straightforward connection to the image driver circuitry of the electrostatic marking device. Such a connection, represented generally by block 712 in FIGS. 1 and 2, can be made using different methods in order to satisfy particular functional requirements. Prior art connection from the nibs of the nib line to the image driver circuitry, as shown in FIG. R, was by way of a ganged group of connectors that were insulated from each other in a many-to-one connection; that is, several writing electrodes are connected to a single driver on the image driver circuitry board by way of the weaving process shown in FIG. 37. Use of conductive pads that are integral with the writing head permits a single nib per driver attachment that eliminates this labor-intensive manual step in the prior art.

Figure 24:
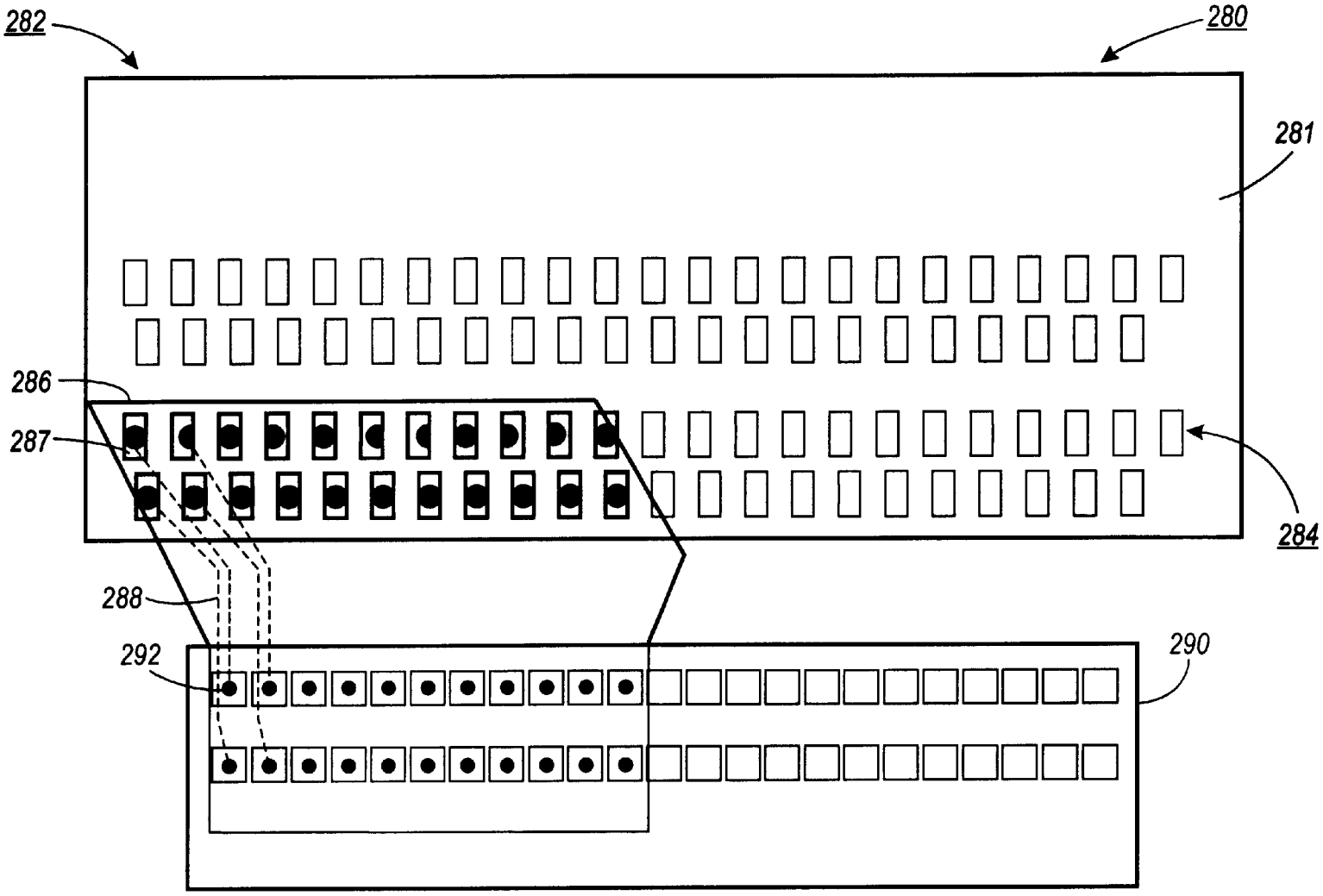
FIG. 24 is a schematic front view of the back surface of a writing head illustrating a connection technique from the conductive pads to the image driver circuitry of the electrostatic marking device.

FIG. 24 illustrates an example of a connection technique that is suitable for use with the present invention. FIG. 24 shows a front view of writing head 280 from the perspective of surface 281 that is opposite to the surface of the first head member to which the conductors are attached; writing head 280 has a nib line at location 282 and conductive pads 284. Flexible cable 286 joins each conductive pad by way of a connection 287 and a conductive trace 288 to a respective driver board connector 292 on image driver circuitry board 290. A semi-rigid or a rigid board connection may also be used in place of a flexible cable to make this connection. Alternatively, an elastomeric connection may also be suitable. An elastomeric connection contains conductive rubber "wires" sandwiched between insulating rubber in a substantially planar arrangement, with connectors at each end that may be spaced as necessary. These connectors, called "zebra connectors" are each mechanically pushed in place coextensively with a respective conductive pad at the writing head and with a driver connection at the image driver board.

A suitable connection between writing head and driver circuitry should achieve complete connection between pads and board, and be of the type that is repairable if writing electrodes in the nib line fail as a result of the manufacturing process. A suitable connection may further be selected on the basis of its installation characteristics. For example, it may be a requirement to use a connector that is intended to be easily removed at the writing head or at the driver board, or both, to facilitate repairs of the electrostatic making device in the field. Considerations such as the connector's resistance to ink and resistance to damage from bending may also be factors in selecting an appropriate connector.

B. Process for Making the Writing Head.

The discussion that follows describes the process for making the writing head of the present invention. In particular, the description makes reference to constructing writing head 300 of FIG. 17. It is understood, however, that the process described may be adapted, without significant changes, to making any one of the illustrated embodiments of the present invention, or numerous other variations thereof.

1. Working Substrate Construction.

Figure 25:
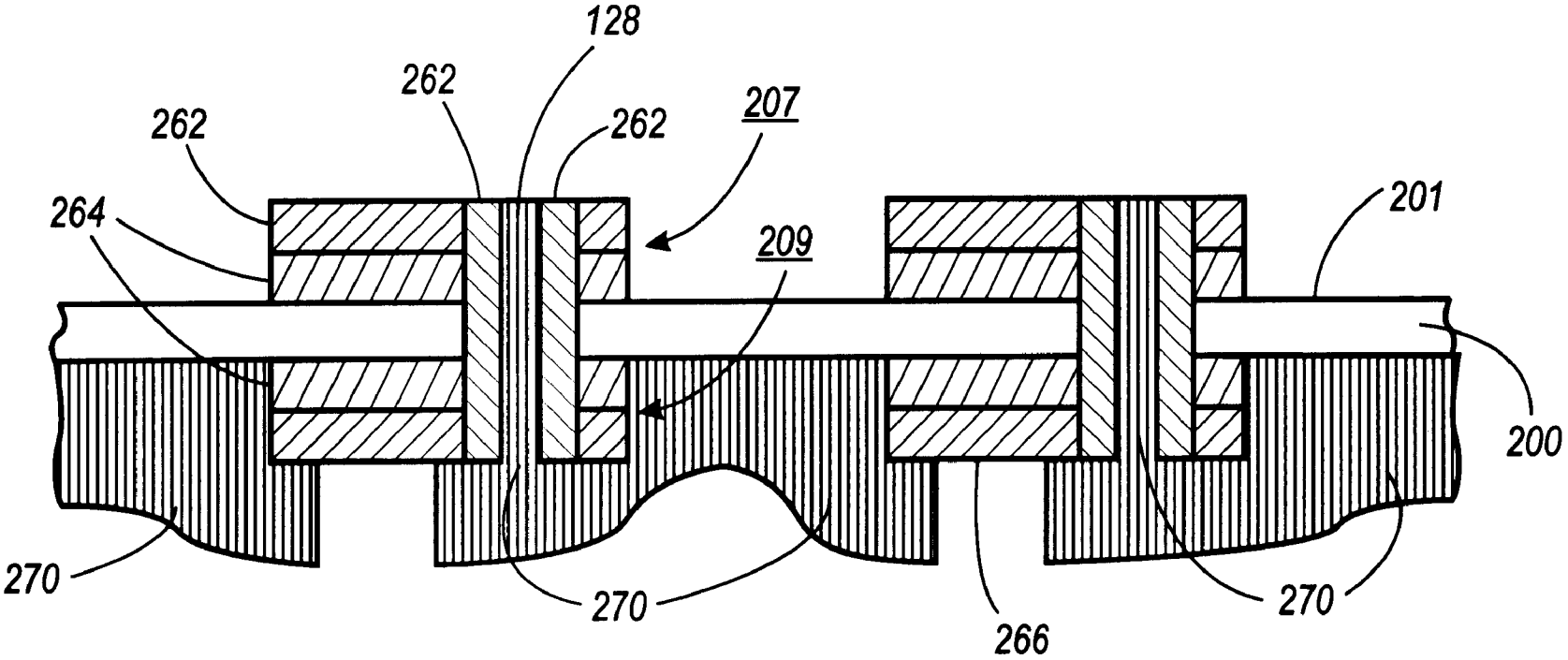
FIG. 25 illustrates a portion of the working substrate of FIG. 12 showing the surface preparation of the working substrate prior to attaching the conductors thereto.

Construction of the writing head first requires fabrication of the integral conductive pads on the working substrate using standard printed circuit board (PCB) technology. FIG. 25 illustrates a small portion of substrate 200 after completion of the conductive pads, viewed from the side of a cut perpendicular to top surface 201 through substrate 200 and conductive pads 207 and 209 of FIG. 12. An elongated substrate 200, preferably fiberglass or like material, is laminated on both sides with copper, or any other suitable conductive material, to a specified thickness, forming laminated layers 264. The total thickness of the copper that forms the conductive pads may depend on the type of bonding process used to attach the conductors to the pads. In the construction of writing head 300, one half ounce copper, which produces a plating layer of approximately 0.7 mils, is used as the initial laminate layer. The laminated substrate 200 is then drilled with holes according to the arrangement of the conductive pads desired; these holes will become the conductive vias 128. In the case of writing head 300, two sets of four offset rows of 14.5 mils holes are drilled in laminated substrate 200, each pair of holes being spaced apart by a center-to-center distance of 26.6 mils.

A plating process then applies a second layer 262 of conductive material on top of layer 264 on top surface 201, which coats substrate 200 again and also coats the holes with copper layer 262. The thickness of this second layer determines the overall thickness of the each conductive pad, and thus may also depend on the bonding process used to attached the conductors to the pads. In the embodiment described herein of the construction of writing head 300, ultrasonic welding is used to attach the conductors to the pads; it is preferable for effectiveness of the welding process that the conductive pads have a maximum thickness no greater than 1.8 mils. Thus, the second plating layer 262 may also be of one half ounce copper. Applying a laminate bonding of one half ounce copper followed by a plating layer of one half ounce copper is referred to as "half over half" plating. The conductive pads are then etched out of copper layers 262 and 264, and excess copper is removed from both surfaces of substrate 200. Bonding area 212 (FIG. 12) is also etched out of copper layers 262 and 264 at this time on top surface 201.

In a final fabrication step, the conductive vias are filled using a liquid solder mask, a process referred to as "plugging and tenting" the vias. It is necessary for the conductive vias to be closed or filled during construction of the writing head. In particular, second head member 104 (FIG. 3) is formed by flowing a hardenable adhesive liquid such as epoxy over substrate 200 with attached conductors; the epoxy must be prevented from flowing through the conductive vias during this step. The solder mask is applied to the surface opposite surface 201 which becomes the bottom surface of substrate 200. A silk screen pattern, or mask, across the pads determines the flow of the solder mask; a portion 266 of each conductive pad is protected from the flow of solder mask by the silk screen mask, and the surrounding solder mask flow builds up in a layer 270 over the surface of substrate 200 and the unprotected regions of the conductive pads, and fills the conductive vias.

If the writing head is to be constructed of joined sections, one or both edges of completed substrate 200 are then cut to the desired shape, such as stepped cut 374 of FIG. 20. These sections are then joined according to the process described below to form substrate 400 (FIG. 22) of the desired length. The completed substrate is then ready for the conductors to be attached.

2. Stitching a Writing Head Section.

Figure 26:
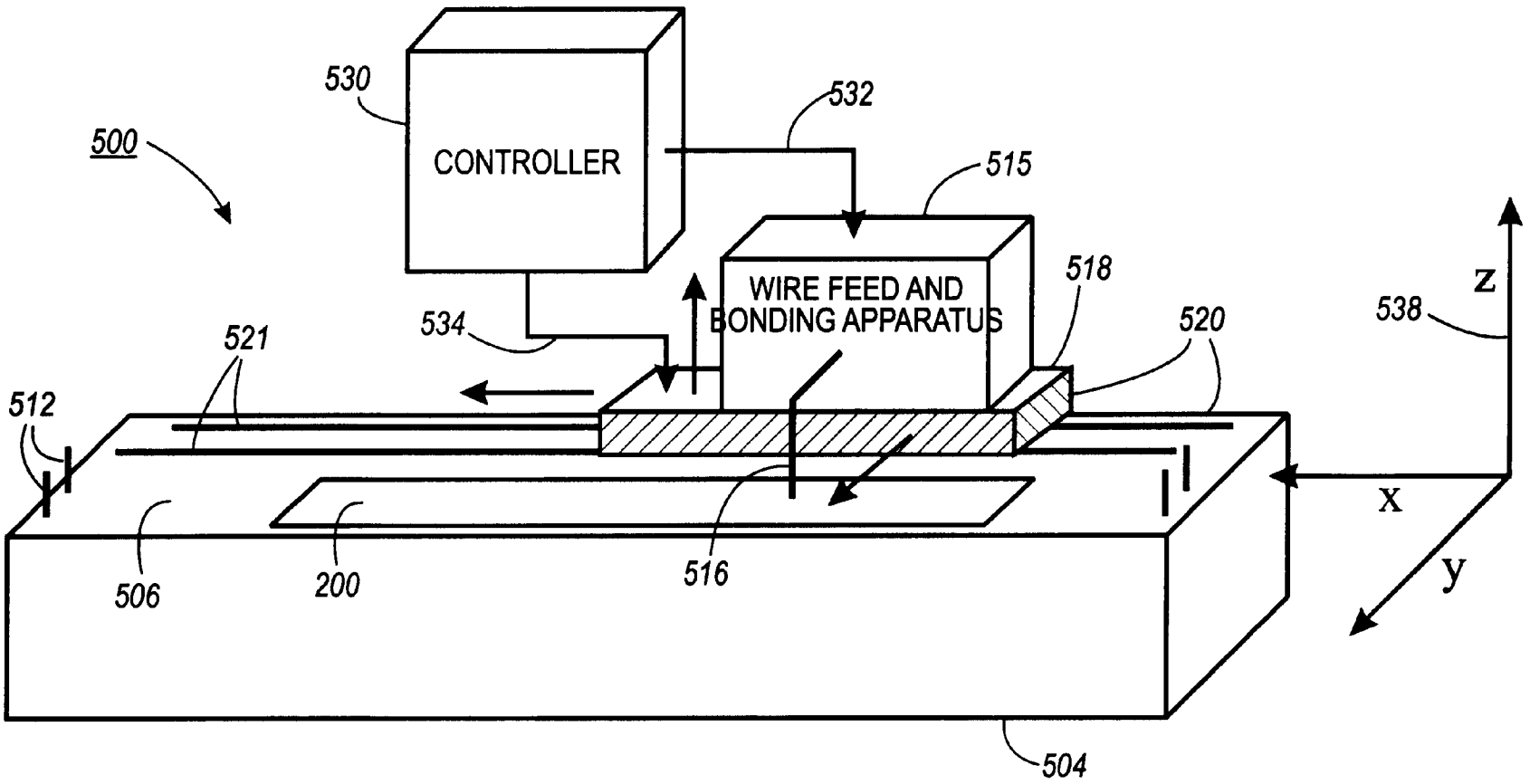
FIG. 26 is a diagrammatic perspective view of an apparatus suitable for performing the automatic attachment, referred to as "stitching", of the conductors to the working substrate.

The process of attaching conductors to substrate 200 (FIG. 26) (or to substrate 400 of FIG. 22, if the head member is composed of joined substrate sections) to produce a writing head is referred to as nib line "stitching". Stitching may be accomplished manually by hand soldering or hand welding each conductor individually to a bonding area (e.g., bonding area 212 of FIG. 22) and then to its proper conductive pad. However, stitching using a bonding device under automatic control is preferred. Apparatus 500 in FIG. 26 is a diagrammatic view of the major components of a device that may be used for the automatic stitching of conductors to substrate 200. A tooling fixture 504 supports and restrains substrate 200 in a fixed position on surface 506, which position is related to a known location of mechanism 516 of wire feed and bonding apparatus 515. Substrate 200 may have mounting holes (not shown) that fit over support pegs (also not shown) on mounting surface 506 of fixture 504, or substrate 200 may be clamped to surface 506, or otherwise securely restrained, in a manner that maintains substrate 200 in direct, unbroken contact with surface 506 of fixture 504 during the stitching process.

Apparatus 500 includes transport system 520 for moving wire feed and bonding apparatus 515 along any one of axes 538. In FIG. 26, transport system 520 is illustrated to include, by way of example, platform 518 and a pair 521 of rails; it will be appreciated by those of skill in the art that other transport mechanisms may be implemented to achieve the same range of motion for bonding apparatus 515 as described below. Bonding apparatus 515, shown mounted on platform 518, includes a wire supply and electronic circuitry (both not shown) for operating device 515 and a wire feed and bonding mechanism 516 which makes contact with substrate 200 to bond a conductor thereto. Platform 518 is secured to a pair 521 of rails mounted to surface 506 that allow platform 518 to move horizontally along fixture 504 in the x direction, thereby moving bonding mechanism 516 over substrate 200 from one end to the other. Bonding apparatus 515 feeds wire through feeding and bonding mechanism 516 and is capable of vertical motion along the z axis, making contact with substrate 200 to bond a wire to its top surface and then lifting off of substrate 200. Bonding apparatus 515 is also capable of forward and back motion along the y axis, for bonding wire to two distinct and physically separated bonding areas on substrate 200, such as a set of conductive pads and bonding area 212 (shown in FIGS. 12, 15 and 22, for example).

Controller 530 is a processor-controlled apparatus under program control that sends motion signals 534 to transport system 520, causing transport system 520 to make incremental movements in the x direction. Controller 530 also sends control signals 532 to bonding apparatus 515, controlling certain functions of bonding apparatus 515 such as wire feed and wire tension. Control signals 532 may also include bonding parameters that directly control aspects of the bonding function itself, such as the depth of the bond, the length of time to complete a bond, and other aspects of the bonding function; control over these parameters could result in bonds that are specifically tailored to the material used or to the accuracy desired. Controller 530 is programmed to send movement signals 534 in a repetitive pattern that causes mechanism 516 to bond lengths of wire to bonding areas on substrate 200 according to a predetermined bonding order. In the case of bonding conductors to substrate 200 for producing writing head 300 of IG. 17, movement signals 534 cause bonding apparatus 515 to bond lengths of conductors to conductive pads according to their arrangement on substrate 200.

Figure 27:
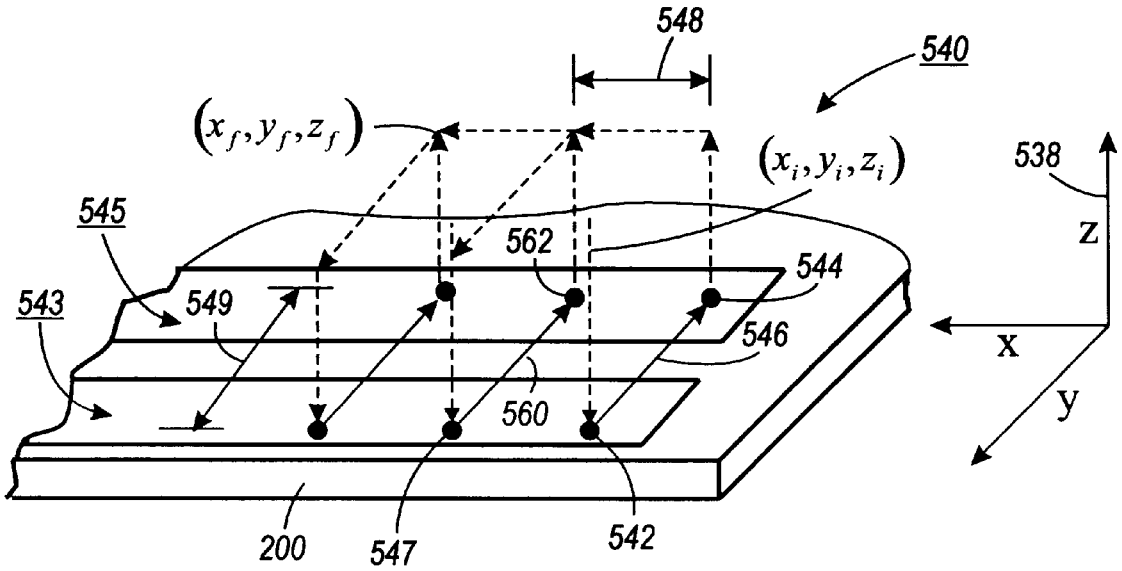
FIG. 27 illustrates an example of a repetitive pattern of motion produced by the controller of the apparatus of FIG. 26 to drive the bonding mechanism to bond conductors to the working substrate.

An example of a pattern 540 of movements controlled by signals 534 from controller 530 is illustrated in FIG. 27 and forms the basis of a description of the operation to of apparatus 500. Substrate 200 has bonding areas 543 and 545 on the surface thereof. The wire feed mechanism 516 of bondine apparatus 515, which is not explicitly shown in FIG. 27, begins at initial position ($x_i$, $y_i$, $z_i$) over bonding area 543 and moves along the z-axis to a position in bonding area 543 at the surface of substrate 200 and bonds one end of a wire that becomes conductor 546 at bond 542. Bonding apparatus 515 then creates tension on conductor 546 as mechanism 516 moves to its next position with conductor 546 held under tension. After bond 542, mechanism 516 then moves a distance 549 to a position in bonding area 545 and bonds the other end of the wire at bond 544, forming conductor 546. The tension applied to the wire during the bonding process causes conductor 546 to lie flat in a plane parallel to the surface of substrate 200. To accomplish the movement across substrate 200 along the y-axis for a distance 549 from bond 542 to 544, mechanism 516 either moves to the position of bond 544 along the y axis at the surface of substrate 200, or first moves along the z-axis a sufficient amount to clear the surface of substrate 200 before moving to the position of bond 544.

After completing bond 544, bonding apparatus 515 causes mechanism 516 to clamp conductor 546; mechanism 516 then moves along the z-axis away from the surface of substrate 200 to some position above bond 544. The motion of mechanism 516 away from the surface of substrate 200 coupled with the clamping of conductor 546 may be sufficient to break conductor 546 at the proper location; however, if the characteristics of the particular bonding apparatus used or the type of bond made cause conductor 546 to break improperly, a cutting device may be added to apparatus 500 and may be activated to cut conductor 546 at or near bond 544, at the edge away from the conductor.

Mechanism 516 then moves transversely along the x-axis a distance 548 that establishes the adjacent spacing between conductor 546 and the next conductor 560 to be bonded to substrate 200. Mechanism 516 then moves laterally along the y-axis to a position over bonding area 543, moves along the z-axis to the surface of substrate 200 and bonds one end of the next conductor 560 at bond 547. Bonding apparatus applies tension to conductor 560, and mechanism 516 then moves either along the y-axis at the surface of substrate 200, or at a distance along the z-axis above the surface, to a position in bonding area 545. Mechanism 516 then bonds the other end of conductor 560 at bond 562. This movement pattern is repeated as shown for all conductors until all conductors are attached to substrate 200. Mechanism 516 completes motion pattern 540 at ($x_f$, $y_f$, $z_f$).

It can be appreciated by those of skill in the art that the pattern of movement signals provided by controller 530 may be varied in a number of ways from pattern example 540. For example, distance 548 may be the distance between n conductors, where n is some intervening number of conductors not jet stitched to surface 200, and where the pattern provides for multiple passes across substrate 200 for attaching these intervening conductors. By way of another example, distance 549 which measures the length of each conductor, may be the same as shown in pattern 540, but also may vary according to a predetermnined order for bonding the conductors. In addition, pairs of consecutive movements which are shown in pattern 540 as two individual movements each along a single axis may be combined into a single movement of mechanism 516; for example; after bond 544, mechanism 516 may move along the z-axis a sufficient distance to clear the surface of substrate 200 and then go directly to the position required for bond 547. In essence, the motion task of mechanism 516 across substrate 200 to bond all of the conductors thereto may be viewed as a shortest path problem, which may be accomplished by a variety of types of motion patterns, subject to the constraint that mechanism 516 maintain a conductor straight and held under tension when moving along the y-axis to complete a bond.

Figure 28:
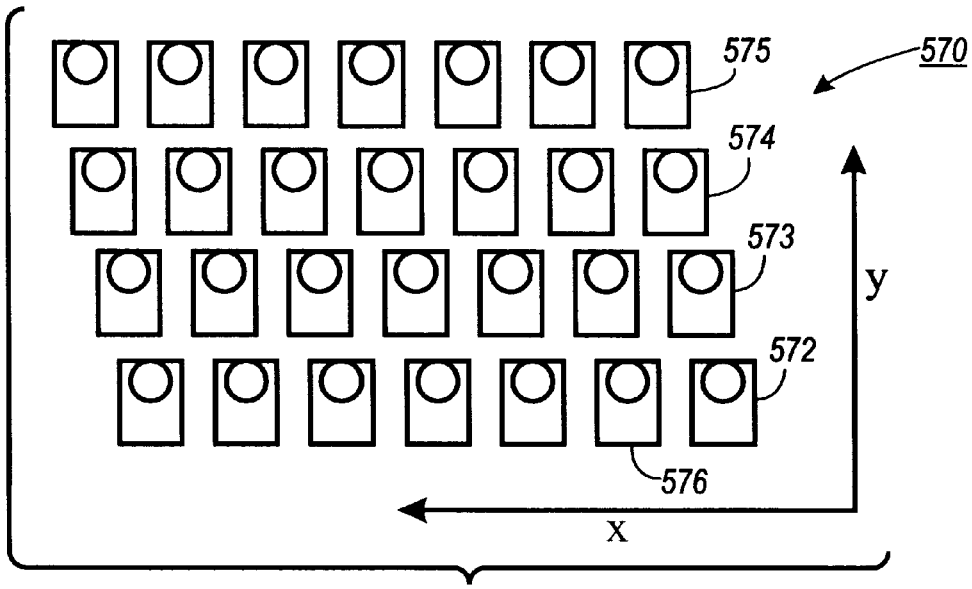
FIG. 28 illustrates the automatic bonding order of the conductors to the working substrate of the embodiment of the writing head of FIG. 17.

A pattern of motion that has been implemented for the construction of writing head 300 of FIG. 17 is illustrated in FIG. 28 by identifying the order in which conductors are attached to the conductive pads. Controller 530 causes wire to be bonded to consecutive pads in the first set 570 of four offset rows, in a pattern that begins with pad 572 and proceeds to the next consecutive pad along the x-axis, which is pad 573, and so on until the four consecutive pads in the four different rows are bonded. Controller 530 then causes mechanism 516 to bond wire to the next consecutive pad which is pad 576. This motion is repeated until a conductor has been attached to each pad in all rows. Then the second set of four offset rows of pads is stitched in the same pattern as the first set.

If insulating spacers are used as described in the discussions accompanying FIGS. 12 and 15, one or more spacers are tied to mountings 512 prior to beginning the stitching of conductors to the first set of conductive pads. The second set of insulating spacers is then tied to mountings 512 after completion of the stitching of the first set of conductive pads and prior to beginning the stitching of the second set.

An embodiment of apparatus 500 has been assembled using an ultrasonic welder manufactured by Anza Corporation of Santa Clara, Calif. as bonding apparatus 515; and a computer manufactured by Acer Corporation as controller 530. The Acer computer uses programmable numerical control software for controlling the movement of transport system 520. Apparatus 500 has also been fitted with a cutting tool to cut the wire immediately after bonding, as described above, and with a small camera that provides a magnified view of the area beneath the wire feed mechanism that permits an operator to monitor the stitching operation.

There are numerous variations of the stitching process just described that may be implemented to accomplish the automatic stitching of the conductors. For example, controller 530 may be adapted to move substrate 200 on a movable support on tooling fixture 504, to position substrate 200 in proper position for a bond from bonding apparatus 515, instead of moving bonding apparatus 515 laterally across tooling fixture 504. A wide variety of bonding processes may be used to bond the wire to substrate 200; the illustrated embodiment uses an ultrasonic welder; contact welding, or spot or resistance welding techniques, as well as other types of bonding processes, are also satisfactory. As noted above, substrate 200 may need to be prepared differently to accommodate the type of bonding selected. In addition, the working substrate may be configured with rows of conductive pads in both bonding areas 543 and 545, with stitching being performed from a conductive pad in area 543 to a conductive pad in area 545 (or vice versa); after the remaining steps for completing a writing head are finished, the result into produce two writing heads from the single stitching process.

After the stitching of working substrate 200 has been completed, a second elongated head member is foraed from an adhesive bonding material, such as epoxy, by flowing liquid epoxy across working substrate 200, in a manner sufficient to cover bonding areas 543 and 545 and the conductors bonded thereto. The adhesive layer is allowed to harden to form a rigid encapsulating layer over working substrate 200 and the entire assembly is cut along cut line 210 (see e.g., FIGS. 12, 15, 19 and 22), thereby exposing a surface of each of the parallel conductors; these surfaces lie in at least one line and form the nib line of the writing head.

3. Joining Multiple Working Substrate Sections to Form a Single Working Substrate.

A process for joining multiple working substrate sections to produce the multi-section working substrate 400 of FIG. 22 has the following fmnctional requirements. First, the working substrate sections must be joined in a manner that produces a joined working substrate with sufficient rigidity and strength to maintain the substrate sections in a joined position, both during the stitching process and thereafter when a completed writing head composed of joined head member sections is installed as a component of an electrostatic marking device. Secondly, since the conductive pads are formed on the working substrate prior to joining, the joining process must ensure that the integrity of the conductive pads remains intact; they cannot become damaged, covered over, or otherwise contaminated during the joining process, since such contamination would prevent conductors from successfully bonding to the pads. Thirdly, the type of joining material used to join the lateral edges of the substrate sections must be of the type that provides sufficient strength at the joint with a minimal amount of material. The width of the gap, or joint, between the joined lateral edges of two substrate sections must be within the range of widths that comprise the acceptable tolerance allowed for the center-to-center distance between two adjacent conductive pads in a single row that occur at the joint.

Figure 29:
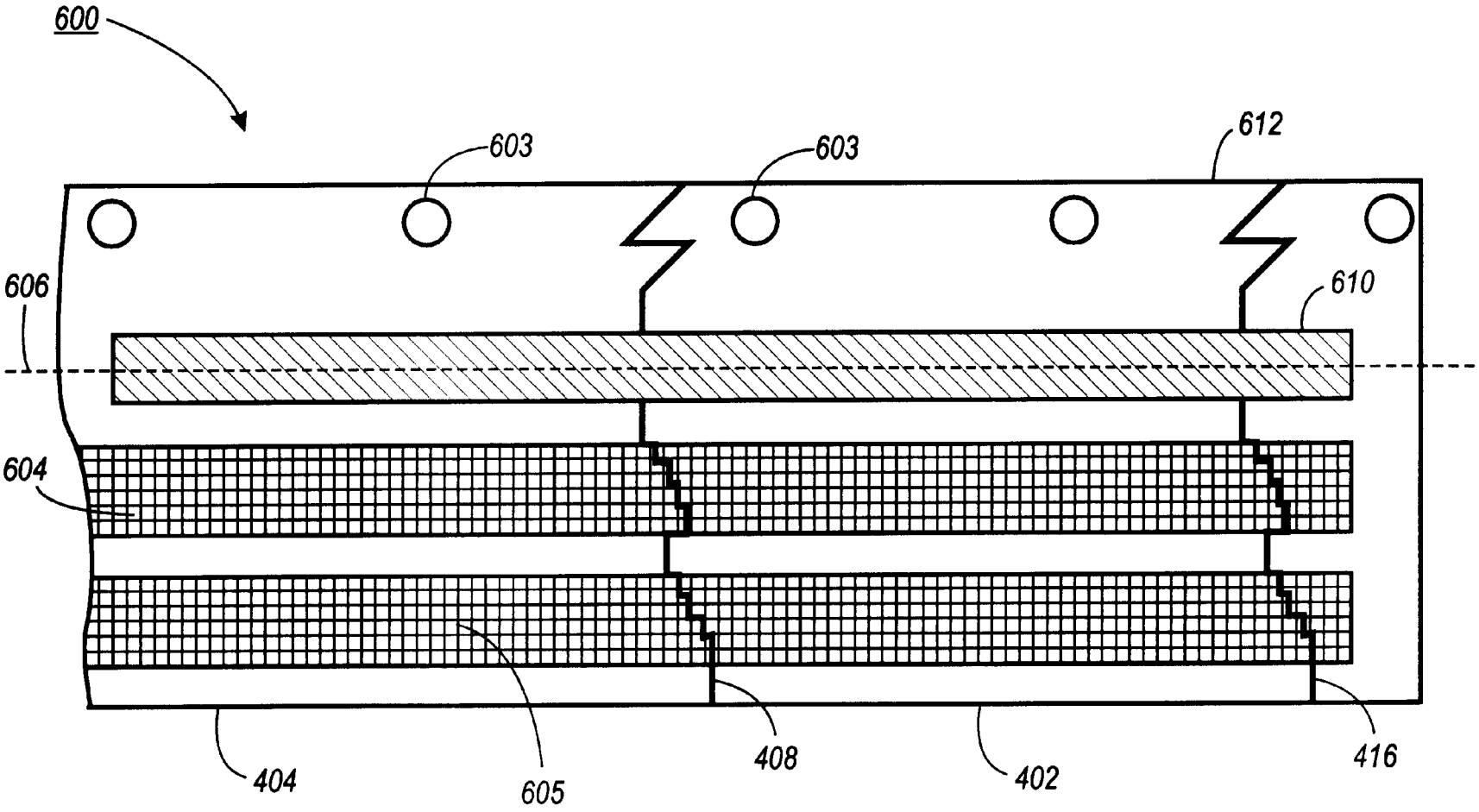
FIG. 29 illustrates the opposite surface of a working substrate that has been joined together according to a joining process illustrated by the fixture of FIG. 32.

FIGS. 29, 30, 31 and 32 illustrate various aspects of the joining process. FIG. 29 shows a front view of a portion 601 portion of the opposite (back) surface 600 of joined working substrate 400 of FIG. 22 that includes sections 402 and 404 joined at their complementary abutting lateral edges to form gap, or joint, 408. Surface 600 also includes two sets 604 and 605 of conductive pads. Surface 600 also now shows tooling openings 603 that are omitted from working substrate 400 in FIG. 22. Stiffening member 610 extends lengthwise across surface 600 a sufficient amount to span all of the gaps of the joined substrate (e.g., gaps 416, 408, 410 and 418 shown on FIG. 22) and to provide the necessary stiffness and rigidity needed by joined working substrate 400. Stiffening member 610 is positioned in a middle region of surface 600 between the two sets 604 and 605 of rear surface conductive pads and the top edge 612.

Figure 30:
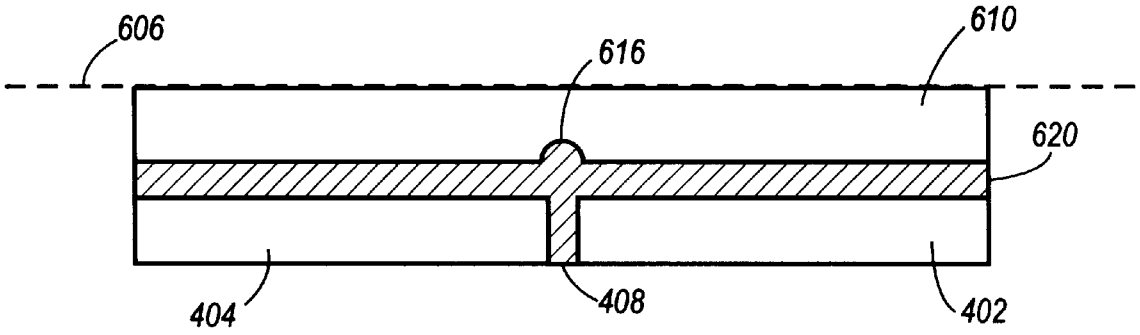
FIG. 30 is a diagrammatic side view of the working substrate of FIG. 29 taken at cut line 606.
Figure 31:
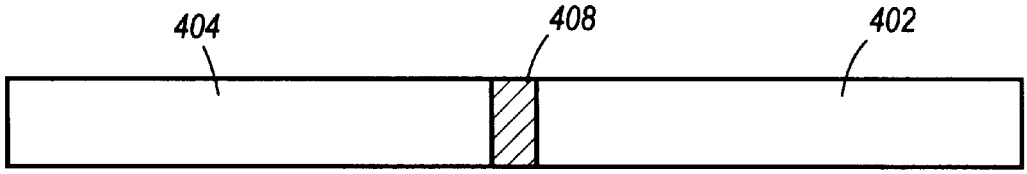
FIG. 31 is a diagrammatic bottom view of a portion of the working substrate of FIG. 29.

FIG. 30 shows an interior layered view of opposite surface 600 taken at line 606 in FIG. 29 through stiffening member 610 and both surfaces of working substrate 400. Layer 620 of joining material lies between stiffening member 610 and substrate sections 404 and 402. Gap 408 is also made of joining material. FIG. 31 is a view of the bottom edge of surface 600, showing individual substrate sections 404 and 402 with gap 408 filled with joining material in between.

Figure 32:
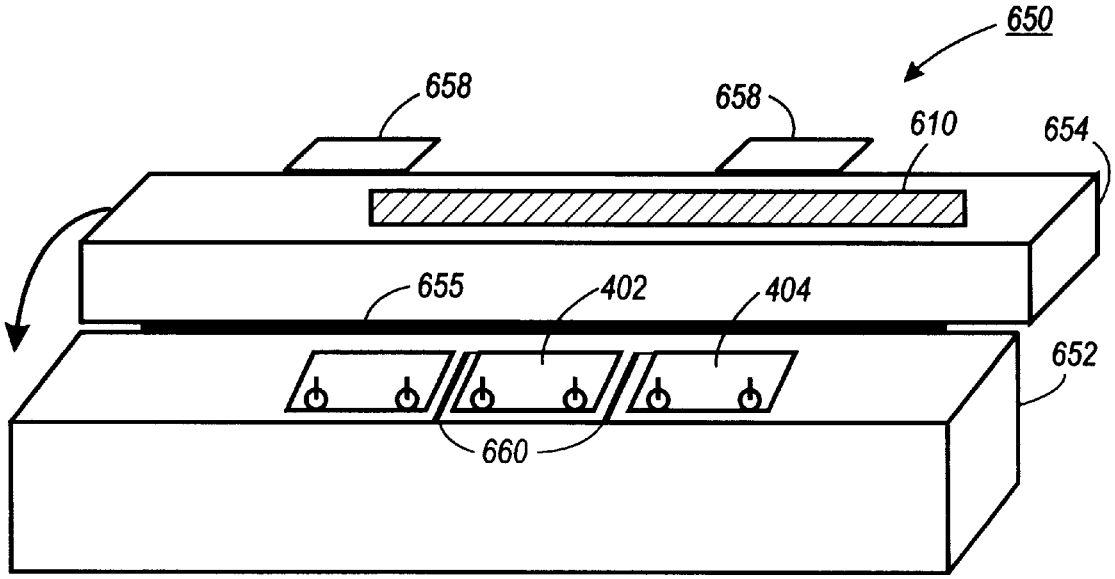
FIG. 32 is a perspective view of an apparatus suitable for joining working substrate sections into a unitary working substrate prior to stitching conductors thereto.

FIG. 32 shows a tooling fixture 650 that may be used to assemble working substrate sections into a unitary working substrate for stitching the conductors thereto. Fixture 650 includes platform 652 for securing the working substrate sections; substrate sections 402 and 404 are shown mounted on platform 652 in a manner that leaves space, or crack, 653 between them. Fixture 650 also includes holding member 654 for holding stiffening member 610 which is shown mounted thereon. Member 654 is capable of radial motion around connecting mechanism 655, which may be a hinge or the like, so as to bring stiffening member 610 mounted on member 654 into contact with the working substrate sections on platform 652. Handles 658 are shown as one way to bring member 654 into contact with substrate sections 402 and 404 mounted on platform 652 by manual lifting.

Platform 652 has a rubber sealing mechanism 660 mounted on its surface at each position where two sections will be joined. Sealing mechanism 660 prevents the joining material that will be applied to crack 653 and stiffening member 610 from flowing to the opposite surface of the substrate sections that is in contact with platform 652. Joining proceeds as follows: substrate sections are placed on platform 652 such that each crack between sections is fitted over a rubber sealing mechanism 660. The sections are then secured to platform 652 by a suitable type of clamping mechanism (not shown). Stiffening member 610 is mounted to holder 654. Stiffening member 610 may be of any material that provides the requisite rigidity and strength to the joined substrate sections. Fiberglass may be used as a stiffening member to join substrate sections 402 and 404. Several drops of a liquid joining material such as epoxy now may optionally be flowed into each crack. Liquid joining material is then applied to the surface of stiffening member 610 and member 654 is then brought into contact with substrate sections positioned on platform 652 and the two components 652 and 654 of fixture 650 are pressed together. The liquid joining material is then allowed to dry to a hardened or cured state.

It is important for sealing the cracks properly to form the gaps at the abutting lateral edges of the substrate sections that the liquid joining material not be forced through the cracks, but rather be allowed to flow the length of the crack. Stiffening member may have notches such as notch 616 in FIG. 30 that extend laterally across stiffening member 610 at every location of a gap between sections to allow the joining material to flow along the notch and gap during the pressing step. In addition, to further prevent contamination of the conductive pads by the joining material, mylar tape may be applied to the cracks on the front surface of the substrate sections to prevent the joining material from seeping through on the front surface.

It will be appreciated by those of skill in the art that a variety of joining materials may be suitable for securing stiffening member 610 to substrate sections. Stiffening member 610 may be made of metal and be mechanically secured or constrained to substrate sections by pop riveting or by a welding, or other suitable bonding, process. Also, other types of adhesive material may be used in place of epoxy.

It will be appreciated by those of skill in the art that the joining method just described is useful in any type of application that shares these three functional requirements for joining substrates: The substrate sections must that produce a joined substrate with sufficient rigidity and strength to maintain the substrate sections in a joined position during a subsequent processing operation on the joined substrate and thereafter when a completed assembly composed of joined substrate sections is installed as a component of another apparatus. Secondly, if components are formed on the substrate prior to joining, the joining process must ensure that the integrity of those components remains intact and they are not contaminated during the joining process so as to prevent the subsequent operation from successfully using the components. Thirdly, when the width of the gap, or joint, between the joined lateral edges of two substrate sections must be within a range of widths that comprise an acceptable tolerance allowed for a distance between two adjacent components that occur at the joint, the type of joining material used to join the lateral edges of the substrate sections must be of the type that provides sufficient strength at the joint with a minimal amount of joining material.

E. An Electrostatic Marking Device Suitable for Using the Writing Head.

Figure 34:
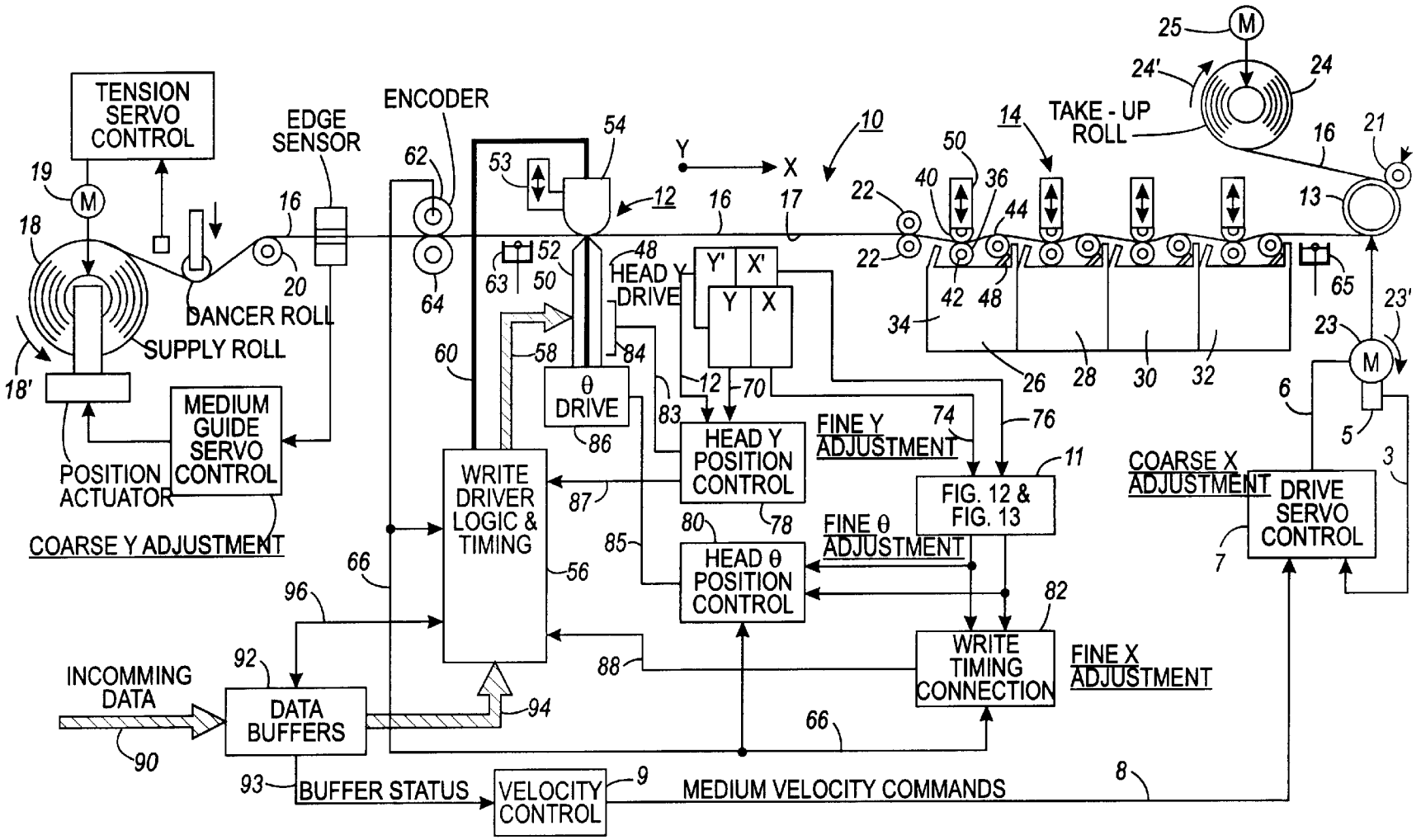
FIG. 34 is a schematic diagram showing a color electrographic marking apparatus in which the writing head of the present invention may be used.
Figure 35:
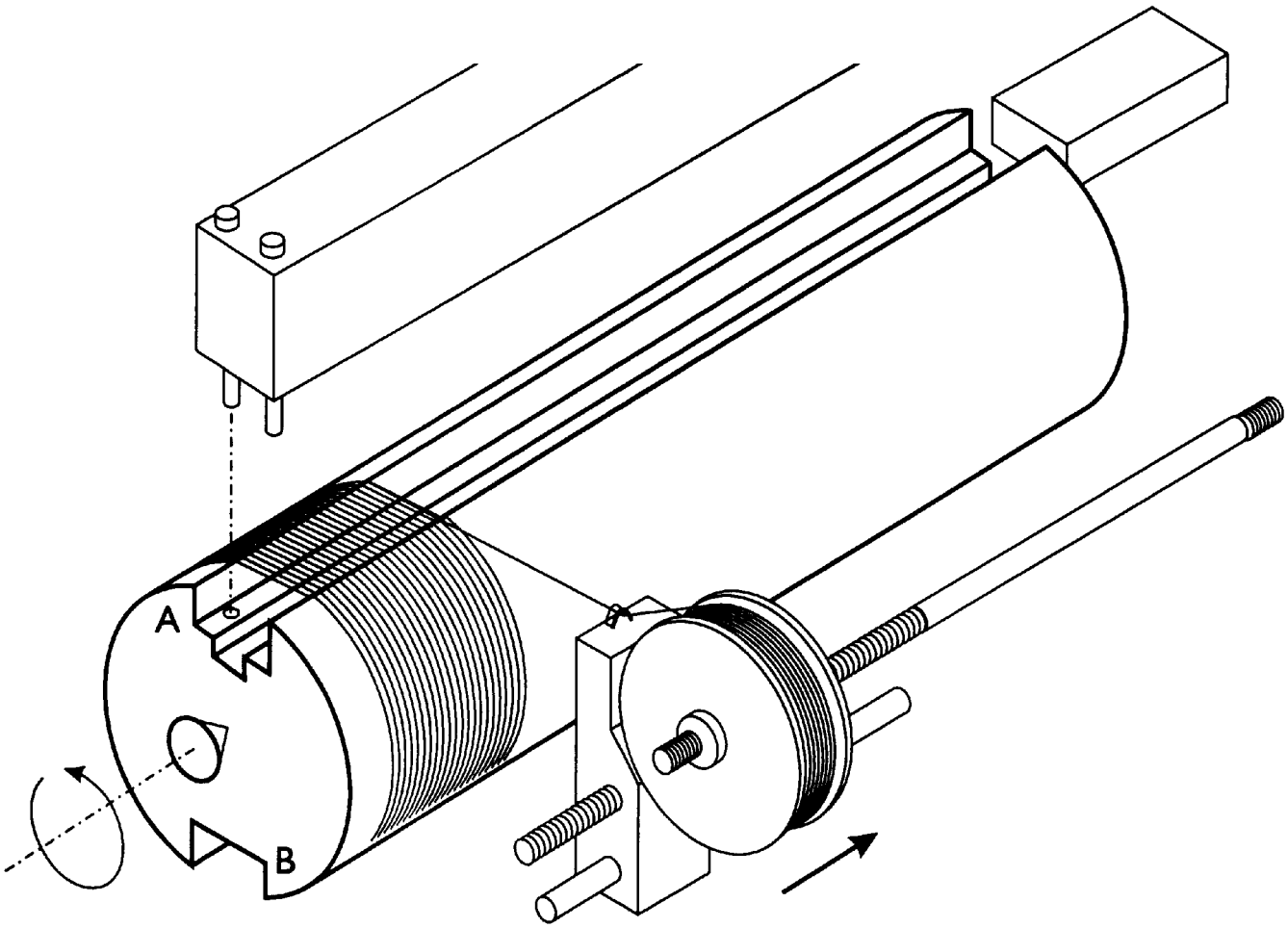
FIG. 35 (Prior Art)
FIG. 35, which is labeled as prior art, is a diagrammatic perspective view of an apparatus in the prior art for making an electrostatic writing head.
Figure 36:
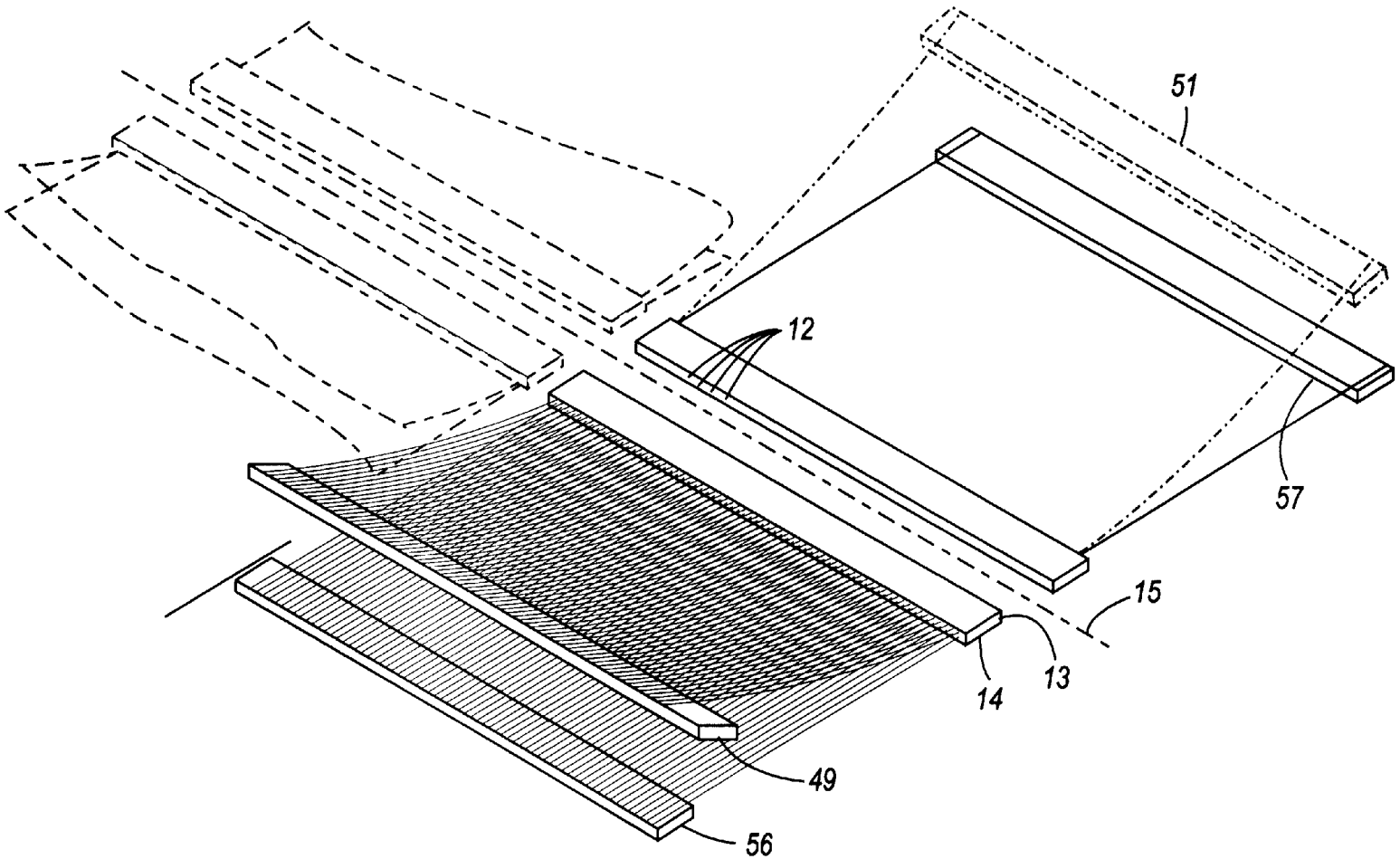
FIG. 36 (Prior Art)
FIG. 36, which is labeled as prior art, is a perspective view diagrammatically showing several writing head assemblies produced using a prior art method that includes performing a cutting operation on the conductor wires and head members produced using the apparatus of FIG. 35.

FIG. 34 illustrates an color electrographic marking apparatus in which the writing head of the present invention may be used. Apparatus 10 happens to be a color device described in detail in U.S. Pat. No. 4,569,584, which is hereby incorporated by reference herein.

Color electrographic marking apparatus 10 produces on a medium a composite color image composed of a plurality of superimposed component images of different colors. In general, marking apparatus 10 includes a single writing station 12 having a writing head 48 for forming a latent image on the medium and a plurality of developers 26, 28, 30 and 32 adjacent to either one side or both sides of station 12 wherein each developer is provided with a respective color to form a color image component of the composite image. The apparatus includes transporting the medium in opposite directions through the apparatus so that a first latent component image is formed at writing station 12 followed by its color component development. Medium reversal is accomplished at least once so that a second latent component image is formed superimposed over the first developed component image followed by its color component development. Then medium reversal is accomplished at least once again so that a third latent component image is formed superimposed over the first and second developed component images. The process is repeated again for as many color component images as desired. The developer component is positioned on one side of the station; in order to form several color component images to produce a color composite. the direction of the medium is reversed after the formation of a color component image and then reversed again to form the next latent component image.

A registration assembly is associated with the transport of the medium and the formation of each component latent image so that the component color images will be superimposed on one another with sufficient accuracy to effectively eliminate color fringes, color errors and color misalignments objectionable to the human aesthetics and disruptive of high composite image resolution.

Sensors associated with the transport of the medium photoelectrically sense tracking indicia on the medium and provide electrical signals representative of information as to the dimensional extent both laterally and longitudinally of the medium section being handled by the apparatus. This information provides adjustment for both lateral and longitudinal registration of component latent images. Lateral and longitudinal dimensional changes in the medium derived from observation or an aligned row of registration marks is indicative of changes in length, either expansion or shrinkage of the medium section under observation. Coarse correction for lateral alignment of the medium relative to the writing head due to medium shifting in the medium path is accomplished by the lateral translation of the medium supply roll while fine correction for lateral concurrent latent image alignment due to medium expansion or shrinkage accomplished by the lateral translation of the writing head to re center the head relative to the medium, or by the lateral shifting of the energization of the writing head and the lateral start point of the latent image formation, which is described in more detail in U.S. Pat. No. 4,007.489.

With continued reference to FIG. 34, apparatus 10 comprises a station 12 and developing means 14 adjacent to station 12. Both station 12 and developing means 14 are aligned in the path of the medium 16. Medium 16 is drawn from supply roll 18 in the x direction over a series of rolls in the bed of apparatus 10, by means of drive roll 13 driven by drive motor 23. A series of rollers 21 are provided to ride against drive roll 13 in order to provide a firm grip on the medium 16. The medium 16 is taken up on take-up roll 14 driven by take-up motor 25.

Supply roll 18 is also provided with a drive motor 19 to rewind the paid out medium 16 back onto supply roll 18 for further processing by apparatus 10. Supply roll motor 19 continuously applies a driving force in the direction of arrow 18 while take up motor 25 continuously applies drive in the direction of arrow 24. These oppositely opposed drives maintain medium 16 in a state of equilibrium until drive motor 23 is enabled in either direction. as indicated by arrow 23, either to drive the medium forward at a relatively slow rate for processing by apparatus 10 or to drive the medium 16 forward at a relatively fast rate to wind the medium 16 back onto supply roll 18.

Developing means 14 comprises a series of applicator roll type liquid development fountains: 26, 28, 30 and 32 each of identical design. The fountains 26–32 are the subject matter of U.S. Pat. No. 4,454,833. Other types of developing fountains may be employed in apparatus 10. For example, a dry toner system may be employed similar to that disclosed in U.S. Pat. No. 4,121,888. Also, the vacuum type liquid development fountain disclosed in U.S. Pat. No. 49239,092 is suitable for use in apparatus 10, except that it is preferred that the individual vacuum fountains be selectively brought into engagement with and withdrawn away from the surface 17 of medium to be developed.

Each of the fountains 26–32 comprises a liquid toner container 34 within which is partly submerged the toner applicator roll 36. Each fountain 26–32 is provided with a particular liquid toner color component. For example, fountain 26 may contain black liquid toner, fountain 28 may contain magenta liquid toner, fountain 30 contains cyan liquid toner and fountain 32 may contain yellow liquid toner. Toner container 34 is provided with an inlet and outlet for replenishing the supply of liquid toner in a mariner illustrated in U.S. Pat. No. 4,289,092. Roll 36 is rotated at high rotational velocity, e.g., 750 rpm with clockwise rotation when viewing FIG. 34. by means of a motor 38 (not shown). The high rotational velocity provides a sheath of liquid toner in a development gap between roll 36 and its backup roll 40. Resilient doctor blade 42 wipes roll 36 clean of excess toner and also aids in preventing toner buildup on its surface.

Just beyond the applicator roll 36 in each fountain is a drying roll 44. Drying roll 44 is rotated by means of a motor (not shown) at a higher rotational velocity than applicator roll 36, e.g., 1200 rpm with counterclockwise rotation when viewing FIG. 34. Roll 44 removes excess toner from medium surface 16 as well as providing a drying action to its surface. Resilient doctor blade 48 is applied against roll 44 to wipe the excess toner from its surface.

Station 12 comprises a writing head 48 having one or more aligned rows of writing stylus electrodes 50 supported in a dielectric support 52. Oppositely opposed but in alignment with the electrodes 50 is an aligned row of backup electrodes 54. An example of the combined electrodes means 50/54 is disclosed in U.S. Pat. Nos. 4,042,939 and 4,315,270. Writing electrodes 50 are electrically coupled to write driver logic and circuit 56 by means of conductor harness 58 while backup electrodes 54 are electrically coupled to circuit 56 by means of a group of conductors 60.

Since apparatus 10 provides for medium 16 to be rewound rapidly onto supply roll 18, it is desired that a pneumatic, hydraulic or electrochemical lift 53 be provided for the backplate assembly of backup electrodes 54. Electrodes 54 are lifted up out of position and away from the writing electrodes 50 when writing is not occurring and the medium is in the fast REWIND mode, termed MODE M3.

Encoder 62, backed by roller 64, is adapted to run with the moving medium and may be positioned at any convenient location along the medium path through apparatus 10. The output of encoder 62 is supplied to write driver logic and timing circuit 56 via line 66 as well as write time adjustment circuit 86 and head θ position control circuit 80. Encoder 62 provides a series of pulses per revolution, each pulse representative of an incremental distance of medium movement.

Incoming data for application by circuit 56 to electrode means 50/54 is supplied from a host computer at input 90 to data buffers 92. Buffers 92 represent various buffer delay logic for the purpose of holding two or more lines of data to be presented to the writing electrodes 50 under the control of circuitry 56. The output of buffers 92 is presented on bus 94 to circuit 56. Circuit 56 includes circuitry for data buffer control via lines 96, write timing, high voltage supply, writing electrode (nib) drivers, backup electrode (backplate) drivers.

The output line 98 from the data buffers 92 is a signal that represents the buffer states. i.e., whether or not the buffers are filled with incoming image data. This status is supplied as an input to velocity control circuit 9 which based upon buffer status, supplies medium velocity and direction commands to drive servo control 7 via line 8. Drive servo control 7, in turn, drives and controls the speed and direction of drive motor 23 via line 6. Control 7 maintains precise motor speed by utilizing a speed servo loop including tachometer 5, the output of which is connected to control 7 via line 3.

Drive servo control 7 drives motor 23 dependent on the rate of incoming data to be presented to the writing electrodes 50. As such. this control is termed coarse X adjustment in providing a plurality of different forward medium velocities based upon the amount and status of data available for presentation via circuitry 56 to writing electrodes 50 and forming deposited scan lines of data on medium 16 upon sequential operation of the series of backup electrodes 54 as the medium is stepped forward.

Pairs of photosensors X, Y, X' and Y' each of which include their own light source (not shown) directed toward the medium surface, are positioned adjacent to the medium 16 between the station 12 and the developing means 14. These photosensors are actually pairs of photodiodes coupled at their cathode to a source of positive bias.

As shown in FIG. 34, sensors Y and Y' have their respective outputs 70 and 72 connected to head Y position control 78. Sensors X and X' have their respective outputs on lines 74 and 76 connected to circuit 77 comprising initial signal processing circuitry for the X and X' sensors and start plot logic circuit (not shown). The X and X' processed signals are placed on respective output lines and from circuit 77 to head θ position control 80 and to write timing correction 82. Head Y position control 78 has an output 83 connected to Y stepper drive motor 84 and a second output 87 connected to the write driver logic and timing circuitry 56. Head θ position control 80 has an output 85 connected to head θ stepper drive 86. Write timing correction 82 has an output 83 connected to the write driver logic and timing circuitry 56.

Adjacent to the payout of medium 16 from supply roll 18 is a dancer roll which is supported in a conventional manner to provide predetermined level of bias on medium 16. The function of the dancer roll is to ensure that a predetermined amount of tension is applied to medium 16 as it is paid off of supply roll 18. A servo control monitors changes in the desired tension and either increases or decreases the back torque on motor 19, as the case may be, for correcting to the desired level of medium tension. Coarse Y adjustment for medium 16, i.e., lateral adjustment of medium position relative to head 48 is achieved by a supply roll position actuator. Note also that the tension torque applied in oppositely opposed directions by drive roll motors 19 and 24 may be generally sufficient for providing any necessary medium tension.

Between station 12 and encoder 62 is a corotron 63 that extends the width of medium 16 in the Y direction. There is a similar corotron 65 between fountain 32 and drive roll 13. Corotrons 63 and 65 aid in the removal of residual charge from the medium surface 17 by applying a charge of opposite polarity to that provided by writing electrodes 50. In this manner a new latent component image may be formed at station 12 without any interference from previously deposited electrostatic charge from the creation of the previous image forming pass of the same medium section through station 12. Either one corotron or both corotrons 63 and 65 may be employed to perform this function.

While the present invention has been described in conjunction with one or more specific embodiments, this description is not intended to limit the invention in any way. Accordingly, the invention as described herein is intended to embrace all modifications and variations that are apparent to those skilled in the art and that fall within the scope of the appended claims.

What is claimed is:

1. A method for constructing an electrostatic writing head having a nib line, the method comprising the steps of:

providing a working substrate having a substantially planar first surface including first and second bonding regions disposed thereon;

positioning a conductor bonding apparatus in an initial bonding position relative to the first surface of the working substrate;

performing a plurality of bonding operations to bond a plurality of conductors to the first and second bonding regions using the conductor bonding apparatus and using a processor-controlled apparatus; the processor-controlled apparatus controlling activation of the conductor bonding apparatus and causing the conductor bonding apparatus to bond, for each one the plurality of conductors, a first end of a conductor to the first bonding region and a second end of a conductor to the second bonding region;

securing an encapsulating member to the first surface of the working substrate such that the encapsulating member substantially encapsulates and physically restrains each conductor in a fixed position relative to the planar first surface of the working substrate; and at an angle substantially perpendicular to the first surface, performing a cutting operation cutting through the encapsulating member, the plurality of conductors and the working substrate at a line between the first and second bonding regions to produce the electrostatic writing head; the cutting operation exposing a cross-sectional surface of each conductor; the cross-sectional surfaces of all conductors lying in at least one line and collectively forming the nib line of the writing head.

2. The method for constructing an electrostatic writing head according to claim 1 wherein the step of performing a plurality of bonding operations includes holding each conductor under tension during bonding of the first and second ends of the conductor using the conductor bonding apparatus.

3. The method for constructing an electrostatic writing head according to claim 1 wherein at least one of the first and second bonding regions includes a plurality of conductive pads disposed in at least one row and equally spaced apart within the at least one row by a fixed distance; and wherein the step of performing a plurality of bonding operations using the processor-controlled apparatus further includes the steps of computing a location of a conductive pad using the fixed distance between the conductive pads; and bonding one of the first and second ends of each conductor to one of the conductive pads.

4. The method for constructing an electrostatic writing head according to claim 1 wherein at least one of the bonding regions includes a plurality of conductive pads arranged in at least two rows and equally spaced apart within each of the at least two rows by a fixed distance; a starting position of a first row of conductive pads being offset from a starting position of a second row of conductive pads by an offset distance such that a prior positioned conductive pad in the first row of conductive pads is spaced apart from a next consecutively positioned conductive pad in the second row of conductive pads by the offset distance; and the step of performing a plurality of bonding operations using the processor-controlled apparatus further includes the steps of computing a location of a conductive pad using the fixed distance between the conductive pads and the offset distance; and bonding one of the first and second ends of each conductor to one of the conductive pads.

5. The method for constructing an electrostatic writing head according to claim 4 further including, prior to performing the plurality of bonding operations, the step of attaching an insulating spacer to the working substrate such that each conductor bonded to a conductive pad crosses over the insulating spacer.

6. The method for constructing an electrostatic writing head according to claim 5 wherein the insulating spacer is positioned on the working substrate in a position that causes each conductor bonded to a conductive pad in the second row of conductive pads and passing over a conductive pad in the first row of conductive pads to be spaced a distance above and not touching a conductive portion of the conductive pad in the first row of conductive pads.

7. The method for constructing an electrostatic writing head according to claim 1 wherein the conductor bonding apparatus bonds the first and second ends of each of the plurality of conductors to first and second bonding regions of the working substrate according to a predetermined bonding order stored in a memory of the processor-controlled apparatus.

8. The method for constructing an electrostatic writing head according to claim 1 wherein providing the working substrate includes positioning the working substrate in a predetermined initial x, y, z substrate position on a tooling fixture; wherein the initial bonding position of the conductor bonding apparatus is an initial x, y, z bonding position; and wherein the processor-controlled apparatus, in controlling activation of the conductor bonding apparatus to bond each conductor, performs the steps of (a) determining an x, y, z change distance and applying the x, y, z change distance to one of the initial x, y, z substrate position or the initial x, y, z bonding position of the bonding apparatus to produce a first-end bonding position;

(b) activating the conductor bonding apparatus to bond, at the first-end bonding position, the first end of the conductor to the first bonding region;

(c) computing a distance to the second bonding region to produce a second-end bonding position; and (d) activating the conductor bonding apparatus to bond, at the second-end bonding position, the second end of the conductor to the second bonding region.

9. The method for constructing an electrostatic writing head according to claim 8 wherein the working substrate is seated on the tooling fixture in a fixed position thereon; wherein the determining step (a) applies the x, y, z change distance to the initial x, y, z bonding position; and wherein the activating step (b) further includes the step of moving the conductor bonding apparatus to the first-end bonding position prior to bonding the first end of the conductor.

10. The method for constructing an electrostatic writing head according to claim 8 wherein the working substrate is seated on the tooling fixture in a movable transport member; wherein the conductor bonding apparatus is fixed in the initial x, y, z bonding position; wherein the determining step (a) applies the x, y, z change distance to the initial x, y, z substrate position; and wherein the activating step (b) further includes the step of moving the transport member to cause the first bonding region on the first surface of the working substrate to be positioned in the first-end bonding position prior to bonding the first end of the conductor.

11. The method for constructing an electrostatic writing head according to claim 1 wherein conductors are formed from a continuous stream of conductor material fed by the conductor bonding apparatus; and wherein the step of performing a plurality of bonding operations further includes the step of terminating the continuous stream of conductor material after the conductor bonding apparatus bonds the second end of each conductor to the second bonding region.

12. A method for constructing an electrostatic writing head having a nib line comprising the steps of:

seating a working substrate in a predetermined initial x, y, z substrate position on a tooling fixture; the working substrate having a substantially planar first surface including at least first, second and third bonding regions thereon; the first and second bonding regions each including at least two rows of conductive pads; a prior conductive pad in a first row of the conductive pads being offset from a next consecutive conductive pad in a second row of the conductive pads by an offset distance; each pair of consecutive conductive pads being separated by a fixed distance;

setting an initial x, y, z bonding position of a bonding apparatus relative to the initial x, y, z substrate position of the working substrate:

for a first plurality of conductors, performing a first series of bonding operations using a processor-controlled apparatus for controlling the bonding apparatus; the first series of bonding operations including the steps of adjusting one of the initial x, y, z substrate position or the initial x, y, z bonding position of the bonding apparatus by an x, y, z change distance to produce a current bonding position in the first bonding region; the x, y, z change distance being computed using a processor-controlled apparatus and using the offset distance and the fixed distance between pairs of consecutive conductive pads in the first bonding region;

activating the bonding apparatus to bond, at the current bonding position, a first end of a conductor to one of the conductive pads in the first bonding region; and repeating the adjusting and activating steps for a second end of the conductor; the second end of the conductor being bonded to the third bonding region;

positioning an insulating spacer laterally across the top of the first plurality of conductors bonded to the working substrate and attaching the insulating spacer to the working substrate;

performing a second series of bonding operations for a second plurality of conductors using the processor-controlled apparatus for controlling the bonding apparatus; the bonding apparatus bonding the first and second ends of each of the second plurality of conductors respectively to a conductive pad in the second bonding region and to the third bonding region; each of the second plurality of conductors crossing over the insulating spacer;

securing an encapsulating member to the first surface of the working substrate such that the encapsulating member substantially encapsulates and physically restrains the first and second pluralities of conductors in a fixed position relative to the planar first surface of the working substrate; and at an angle substantially perpendicular to the first surface, performing a cutting operation cutting through the encapsulating member, the first and second pluralities of conductors and the working substrate to produce the electrostatic writing head; the cutting operation exposing a cross-sectional surface of each conductor; the cross-sectional surfaces of all conductors lying in at least one line and collectively forming the nib line of the writing head.

13. The method for constructing an electrostatic writing head according to claim 12 further including, prior to performing the second series of bonding operations, the step of attaching a second insulating spacer to the working substrate positioned laterally across the top of the first plurality of conductors bonded to the working substrate; the second insulating spacer being positioned in sufficient proximity to the third bonding region so as to cause the surfaces of the second plurality of conductors, after exposure by the cutting step, to lie in a second line separate from the surfaces of the first plurality of conductors lying in a first line; the first and second lines collectively forming the nib line of the writing head.

14. The method for constructing an electrostatic writing head according to claim 12 wherein bonding first and second ends of each of the first and second pluralities of conductors to respective bonding regions of the working substrate is performed according to a predetermined bonding order.

15. The method for constructing an electrostatic writing head according to claim 12 wherein the insulating spacer is positioned laterally across the first plurality of conductors and attached to the working substrate in sufficient proximity to the conductive pads in the first bonding region so as to cause each conductor bonded to a conductive pad in the second bonding region to be spaced a distance above and not touching a conductive portion of the conductive pad in the first bonding region.

* * * * *